United States Patent [19]

Maysilles

[11] 4,455,786

[45] Jun. 26, 1984

[54] TWIST DRILL SHARPENING MACHINE

[76] Inventor: Lynn A. Maysilles, 15140 Hidden Valley La., Rochester, Mich. 48063

[21] Appl. No.: 406,195

[22] Filed: Aug. 9, 1982

Related U.S. Application Data

[63] Continuation of Ser. No. 191,161, Sep. 26, 1980, abandoned.

[51] Int. Cl.[3] ..... B24B 7/00

[52] U.S. Cl. ..... 51/46; 51/50 R; 51/288; 51/67; 51/237 R

[58] Field of Search ..... 51/50 R, 50 PC, 94 CS, 51/56 R, 219 R, 219 PC, 288, 67, 89, 237, 46

[56] References Cited

U.S. PATENT DOCUMENTS

| | | | |
|---|---|---|---|
| 3,114,988 | 12/1963 | Garrison | 51/219 R |
| 3,584,420 | 6/1971 | Southland | 51/219 R |
| 4,001,975 | 1/1977 | Bernard et al. | 51/219 R |

*Primary Examiner*—E. R. Kazenske
*Assistant Examiner*—Fridie, Jr. Willmon
*Attorney, Agent, or Firm*—William L. Fisher

[57] ABSTRACT

An improved twist drill sharpening machine for sharpening two lip twist drills having a base, a chuck for chucking a drill bit W to be sharpened, and a grinding wheel spindle supported on the base, a grinding wheel fast on the spindle, the grinding wheel having a concave grinding surface profile on its periphery, an arrangement for moving the chuck and grinding wheel relative to each other so that the grinding wheel carries out metal removal grinding operations on the drill bit W for sharpening same, and the drill bit W being incrementally in-fed to the grinding wheel on an axis parallel to the grinding wheel axis while held disposed at an acute angle to the in-feed axis, an arrangement for flip-flopping the chuck and drill bit W through 180° rotational arcs of travel during in-feed of the drill bit W, an arrangement for cushioning the chuck and drill bit W at the ends of the 180° rotational arcs of travel, and an arrangement for automatically controlling of said in-feed and flip-flopping of the drill W and for returning it to its in-feed starting position upon completion of the grinding operation thereon.

40 Claims, 26 Drawing Figures

TWIST DRILL SHARPENING MACHINE

This application is a continuation of my prior copending application Ser. No. 191,161 filed Sept. 26, 1980 now abandoned.

My invention relates to twist drill sharpening. Many machines exist for the purpose of resharpening or repointing twist drills. However, they require continuous attention during use and are very time consuming in the set-up operations that are constantly necessary when drill diameters and lengths change. Diameter and length changes are very typical of drill resharpening activity. Presently there are approximately 195 diameters of standard drills from ⅛" to 1.0" inclusive; lengths are almost infinitely variable.

The principal object of my invention is the provision of an improved twist drill sharpening machine which overcomes the foregoing disadvantages particularly in that lengths and diameters need not be considered in its designed operating range. Also, after manual loading of this machine, the sequences necessary for repointing all are automatic and, at the end thereof, the components return to "start" position with the sharpening of the drill complete and the machine ready for the next drill to be sharpened.

The foregoing object of my invention and its advantages will become apparent during the course of the following description, taken in conjunction with the accompanying drawings, in which.

Figure 25:
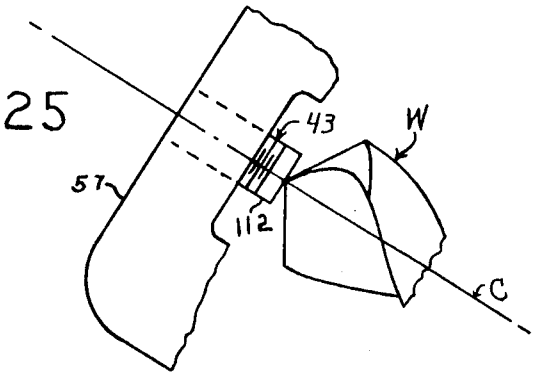
Figure 5:
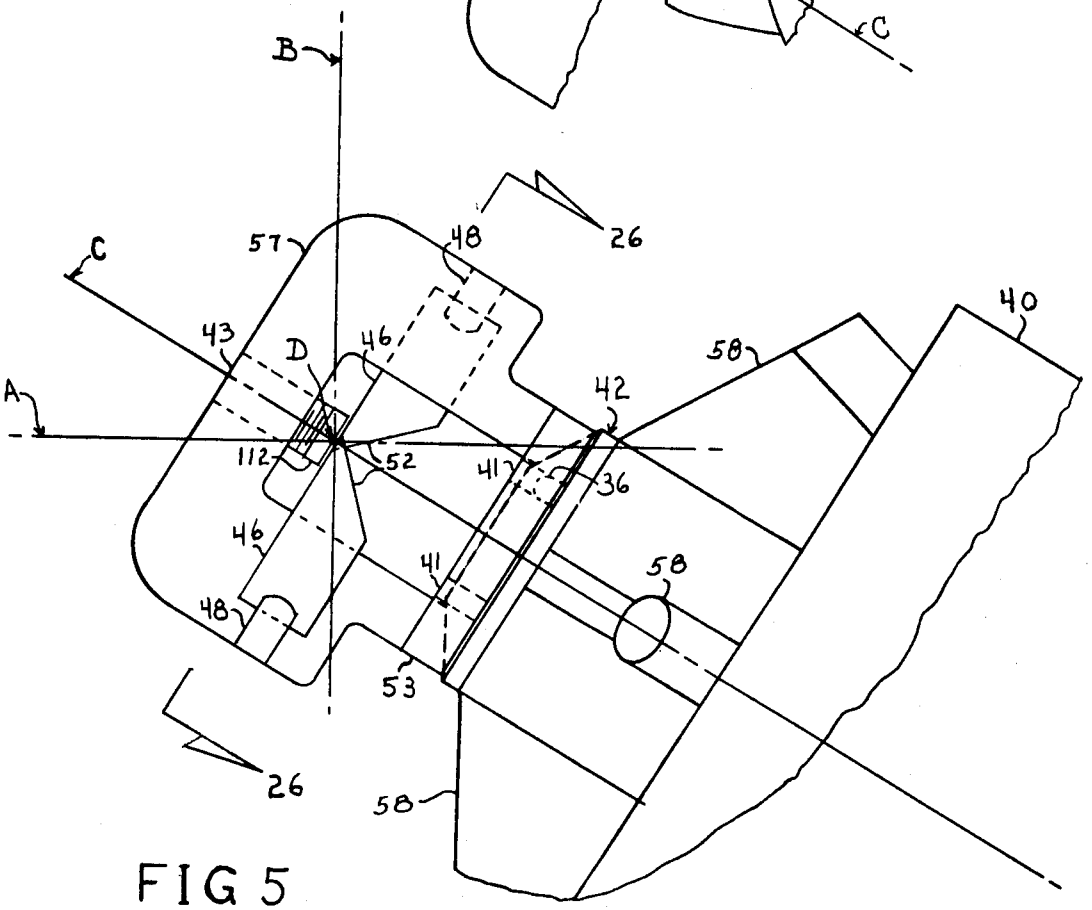
FIG. 5 is a view similar to FIG. 4 but with a loading device shown on the front end of a part of said machine.
Figure 6:
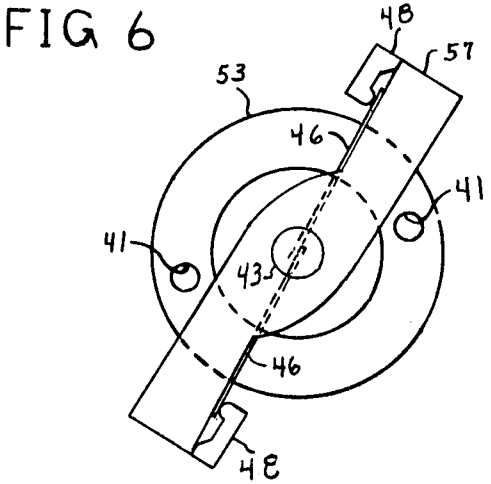
FIG. 6 is a front elevational view of the structure of FIG. 5.
Figure 26:
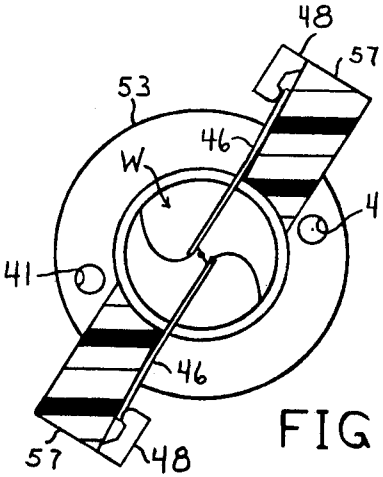
Figure 9:
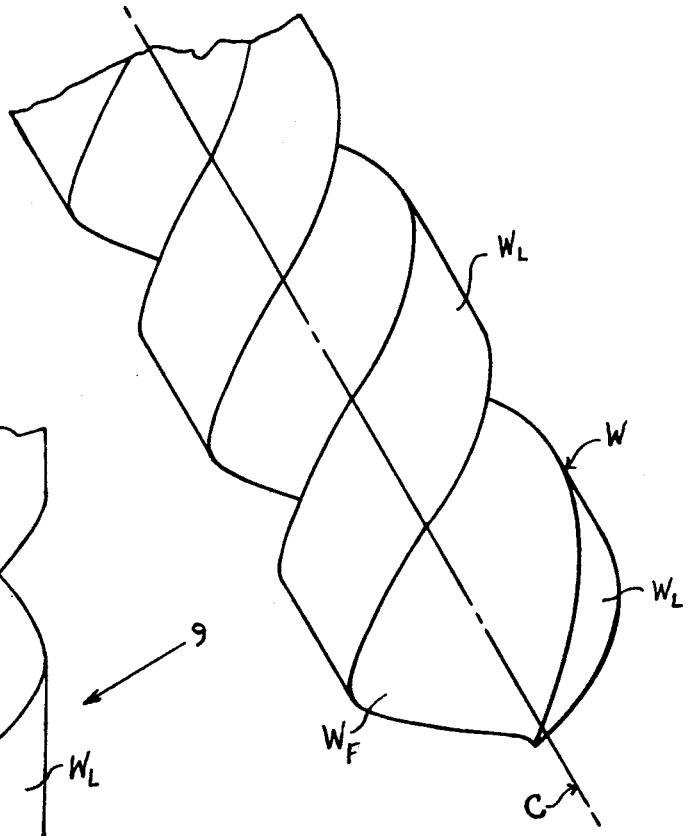
FIG. 9 is an elevational view of the structure of FIG. 8 taken in the direction of the arrow 9 thereof.
Figure 8:
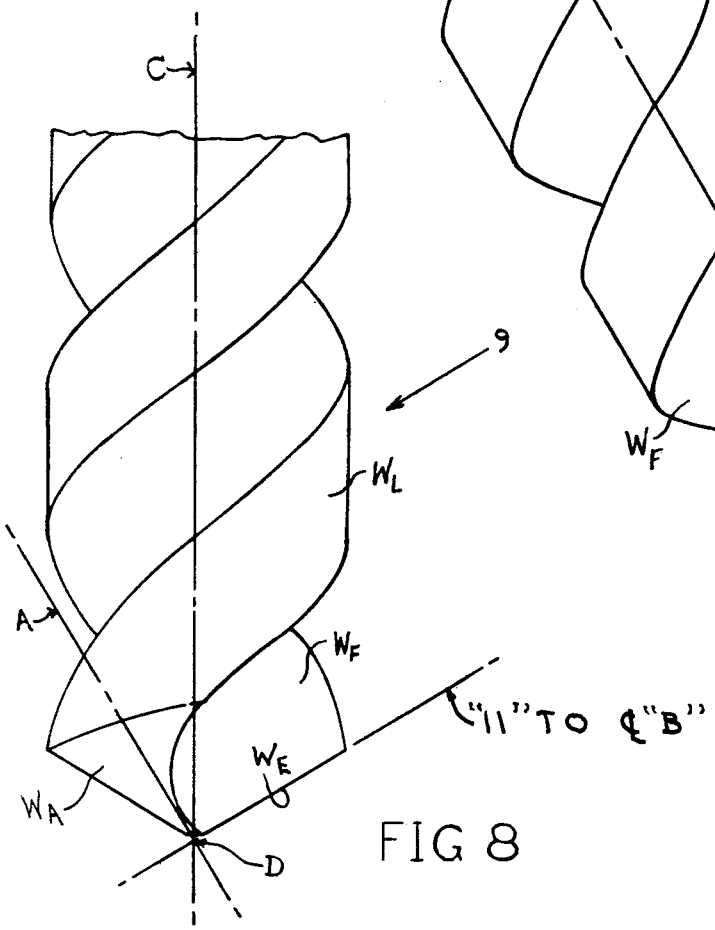
FIGS. 7 and 8 are, respectively, front elevational and fragmentary top plan views of a twist drill adapted to be sharpened by said machine.
Figure 7:
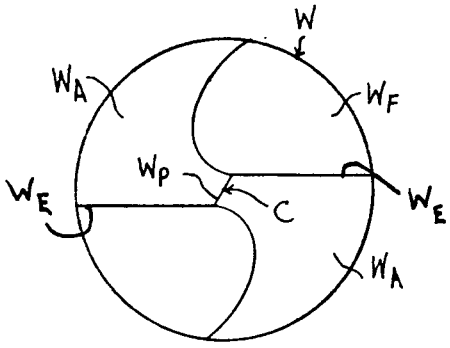
Figure 23:
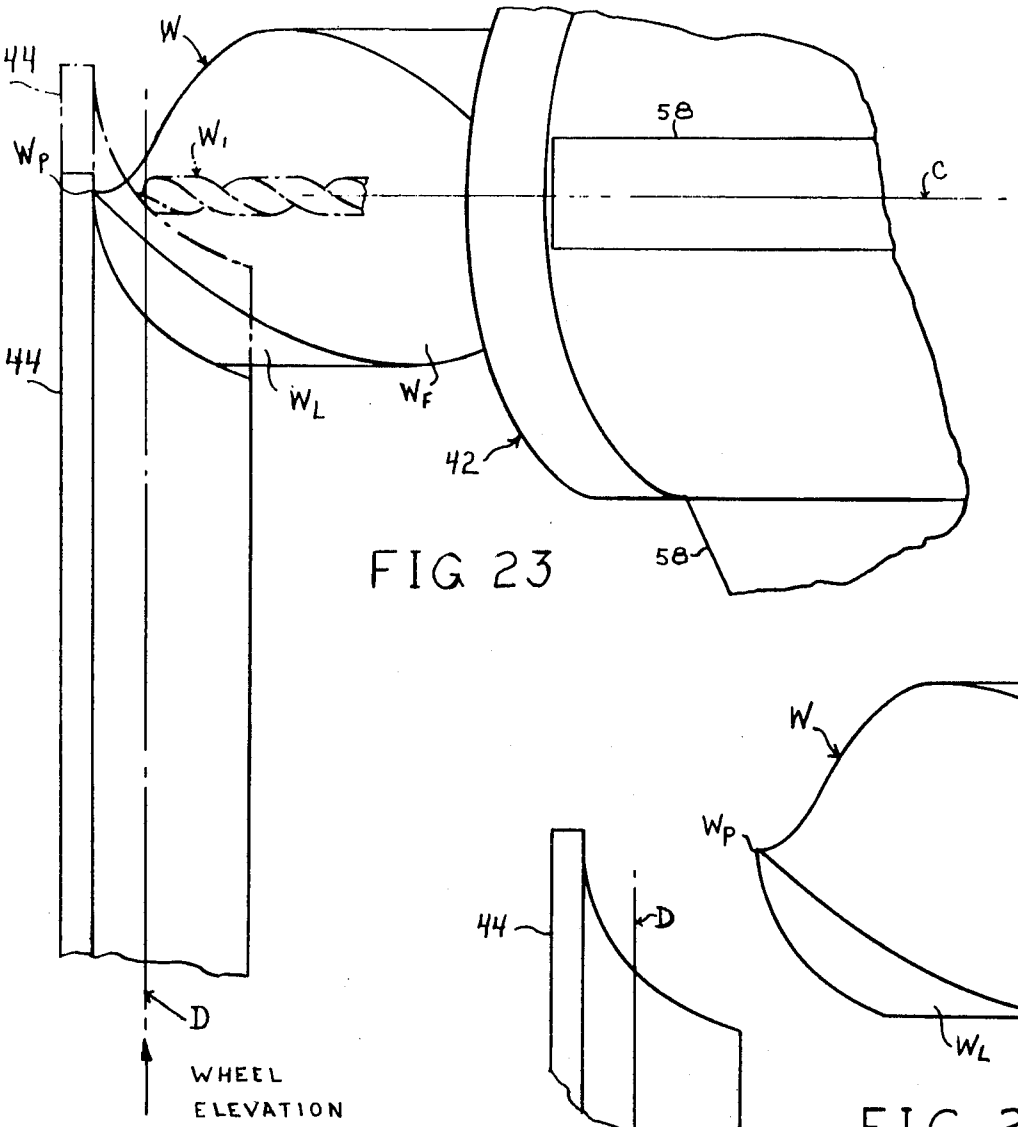
Figure 24:
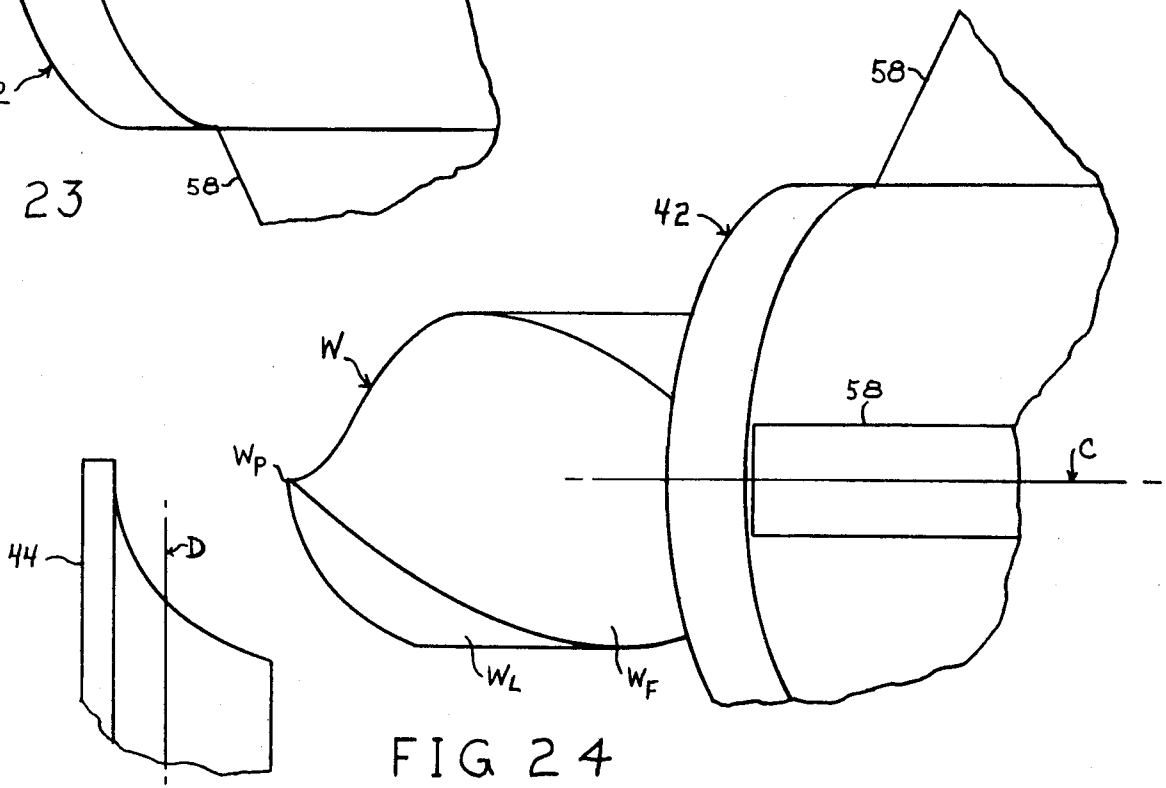

FIG. 23 showing in broken lines said relationship for a smaller diameter twist drill;

FIG. 24 is a view similar to FIG. 23 showing a different position for said first-mentioned twist drill;

FIG. 25 is a view similar to FIG. 5 showing said loading device in relationship to a twist drill; and FIG. 26 is a front elevational view of the structure of FIG. 25 with parts in section.

My machine is composed of the following basic systems:

A. Concave Generated Curve Profile Grinding Wheel
B. Workpiece Holding System
C. Workpiece Loading System
D. Grinding Carriage System
E. Pneumatic System
F. Electrical System
G. Work Feed and Grinding Wheel Positioning System.

A description of the basic systems follows:

The base of said machine can be any rigid table-like device that will support and maintain the relationship of the various components and provide attaching surfaces for the various systems. In this instance, said base is designated 25 and includes a box-like frame of vertical walls and a top plate 31 covering approximately the rear half thereof.

A. CONCAVE GENERATED CURVE PROFILE GRINDING WHEEL

With reference to FIGS. 1, 2, 3 and 23, a grinding wheel 44 is provided in the form of a metal substrate or base having a concave working profile thereon. A matrix and grit of suitable mesh size are plated on said profile. Said profile is located on the periphery of the grinding wheel 44, in the instance, so as to meet the workpiece or drill bit W at the most advantageous relation thereto for sharpening. Referring to FIGS. 7, 8, 9, 22 and 23, said drill bit W has two clearance faces $W_A$, two corresponding cutting edges $W_E$, two corresponding lands $W_L$, two corresponding flutes $W_F$ and a chisel point $W_P$ thereon. Said profile is formed of a composite of discrete curves corresponding respectively to the clearance faces $W_A$ of the different drill bits W to be sharpened. Said profile will impart to each face $W_A$ over the range of workpiece sizes within the designed parameters of said machine a substantially perfect geometry equal to industry standards for new drill bits. During use of the grinding wheel 44 the working profile does not change nor does it need wheel dressing. At most, after long use the grit wears and, in this event, the wheel 44 is repaired by stripping and replating of the profile.

B. WORKPIECE HOLDING SYSTEM

Referring to FIGS. 1, 2, 3, 10 and 11, said work holding system includes a chuck mechanism, generally designated 42 having a base 27 and a long horizontal cylindrical member 60 supported at its rear end by a steel ball bearing 55 in a bearing housing 33 and at its front end by a sliding sleeve or clamping ring 56 enclosed in a fixed bushing 40. The cylindrical member 60 is hollow, as at 32, throughout its length. The bearing support 33 is mounted on the plate 27 and likewise the bushing 40 via front and rear supports 105 and 107, respectively. Both the member 60 and the clamping ring 56 are provided with cavities as shown to accommodate four blades or jaws 58 which move with said clamping ring 56 to clamp work-parts or drill bits, generally designated W. The cavities in the clamping ring 56 are cylindrically shaped in part to accommodate the cylindrical enlargements formed on the outer edges of the jaws 58 so that as the clamping ring 56 moves fore and aft along workpiece axis C, the jaws 58 move with it since they are thus captured in said cavities in said clamping ring 56. The cavities in member 60 are in the form of elongated open ended slots forming long fingers.

To maintain the position of these fingers, a ring is permanently attached thereto and becomes the nose of chuck 42 as shown. Each jaw 58 is provided with an angularly disposed slot 73 through which a pin 54 extends for controlling the movement of said jaw; said pin 54 being pressed into prepared holes in member 60 during assembly of chuck 42. As the jaws close on smaller drills, they move forwardly and closer to the free end of the latter which insures more support closer to the end to be sharpened. Said chuck 42 is a precision chuck having less than 0.001" runout and with a wide range of holding diameters without requiring additional collets or auxiliary spacers.

The clamping ring 56 has a rearward extension as shown which serves as a piston to provide the clamping pressure on the workpart or drill bit W and maintain the same as the latter is being sharpened; said piston operates in a cylinder designated 38 formed by a sleeve affixed to and surrounding a part of body 60 having a shoulder formed therein, as shown. This clamping pressure is in one direction only, viz.; to close jaws 58. Reversing this action, or opening the jaws 58, is accomplished by two externally mounted single action air cylinders 30 having detents 37 slideable in guides 34. The detents 37 extend through suitable slots (not shown) in the fixed bushing 40 and engage an annular notch 62 formed in said clamping ring 56. The two air cylinders 30 operate in tandem via a manifold (not shown) and during movement thereof the detents 37 are held in said annular notch 62 by the holding action of said guide rails 34. As the pistons of said cylinders 30 retract and pull the clamping ring 56 with them, the jaws 58 also retract and open as they are captured in the cavities of the clamping ring 56.

The rear end of the member 60 extends through the bearing support 33 and bearing 55 therein and is reduced in diameter to provide a shoulder for locating and permanently mounting a hollow center driven gear 97 which meshes with another gear 99 mounted on the shaft of a double acting rotary air cylinder or torque motor 101. The central opening 32 extends through said driven gear 97, as shown. Said torque motor is supported on said plate 27. The purpose of this arrangement is to cyclicly rotate the drill bit W 180 degrees so as to present both lips thereof to a grinding wheel 44 at each increment of in-feed. The offset position of said torque motor 101 serves a dual purpose. Said torque motor 101 has a maximum rotational travel of 100° and must be geared to provide the 180° rotational travel of chuck 42 and its clamped workpiece W. Said offset of torque motor 101 also provides clearance for loading and grinding of any length drill bit W; i.e., extra long workpieces W can extend rearwardly along the centerline C beyond the torque motor 101.

Figure 1:
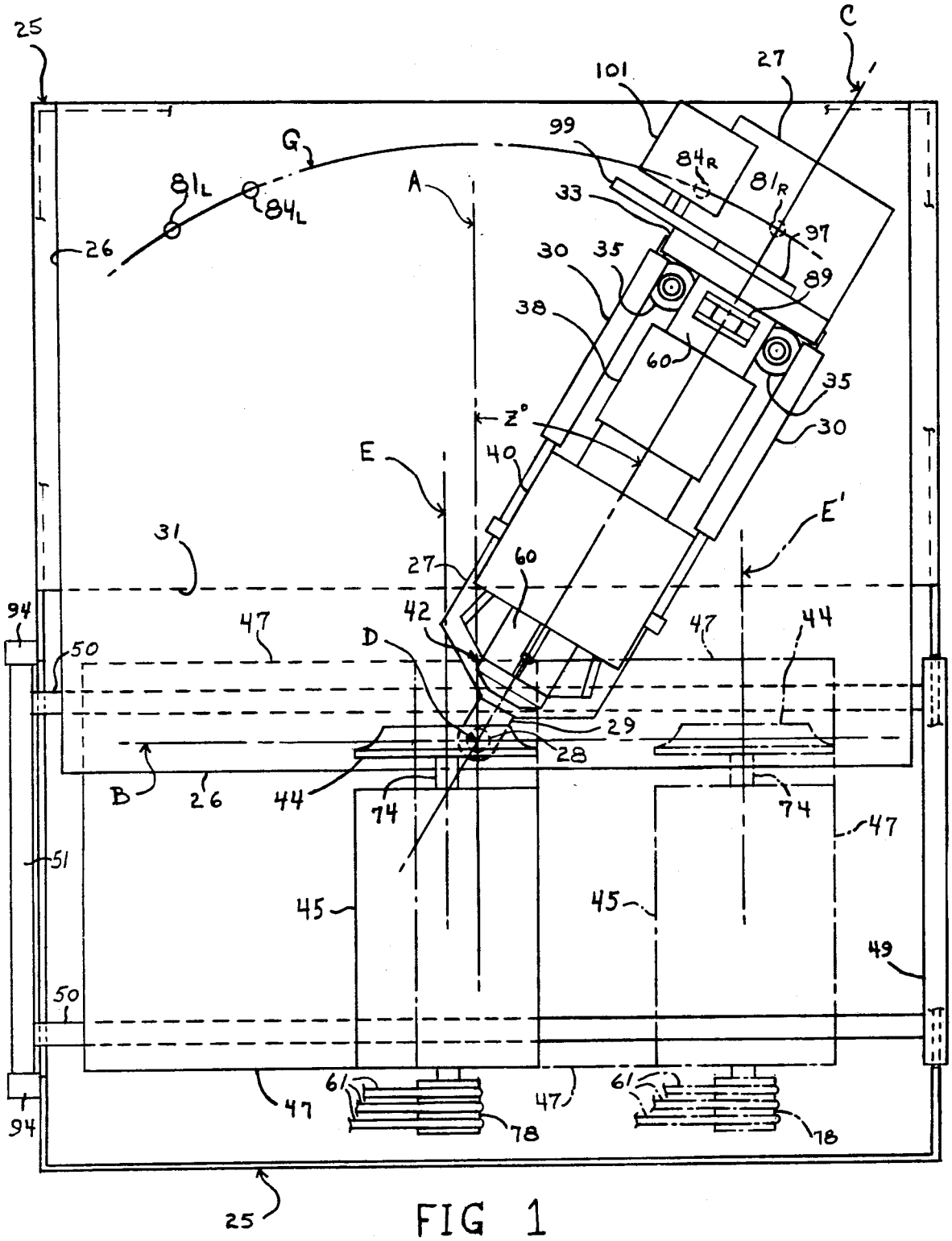
FIG. 1 is a top plan view of an improved twist drill sharpening machine embodying my invention.
Figure 2:
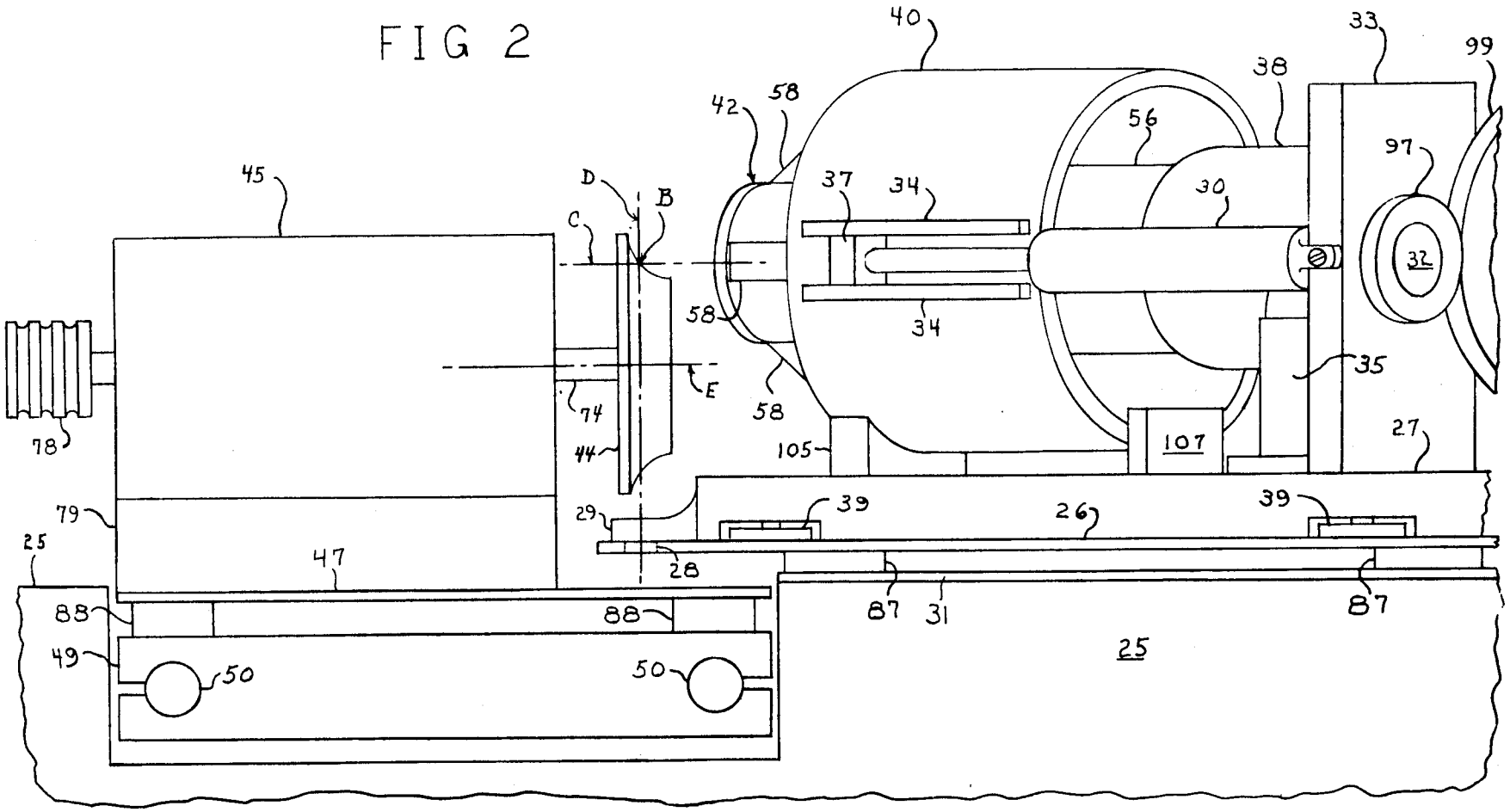
FIGS. 2 and 3 are, respectively, opposite side elevational views thereof.
Figure 3:
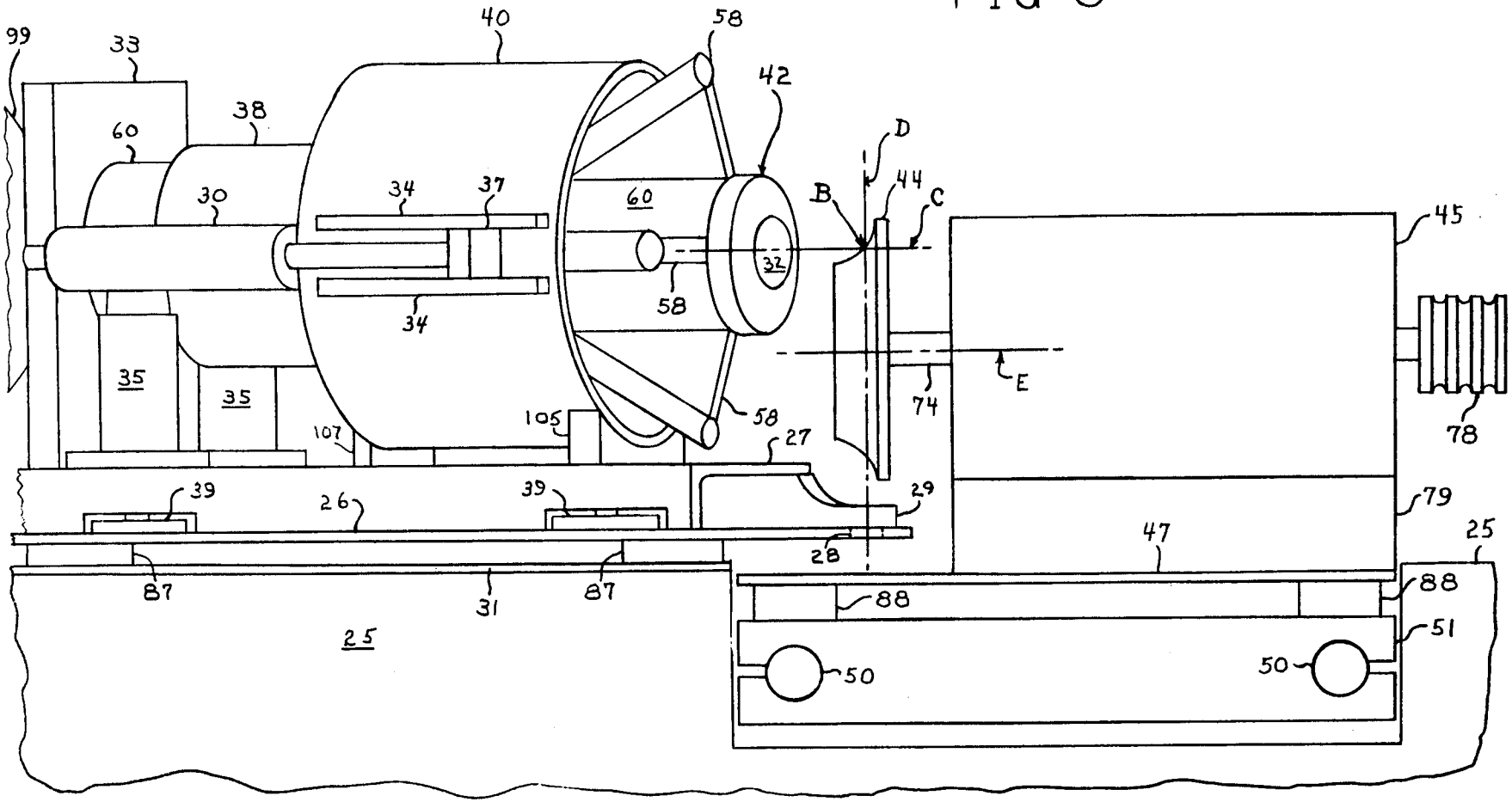
Figure 4:
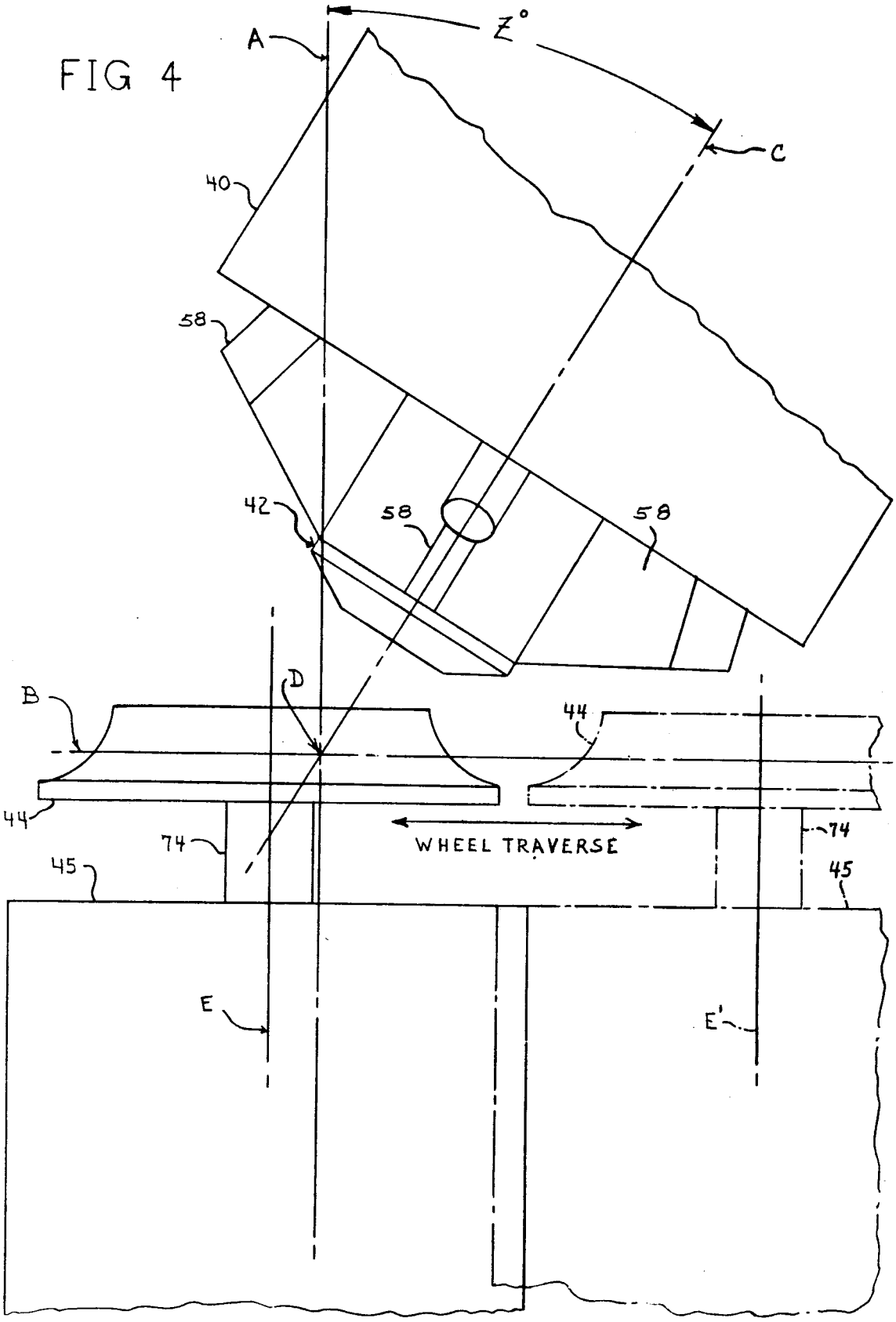
FIG. 4 is an enlarged fragmentary top plan view of the front part of the structure of FIG. 1.
Figure 17:
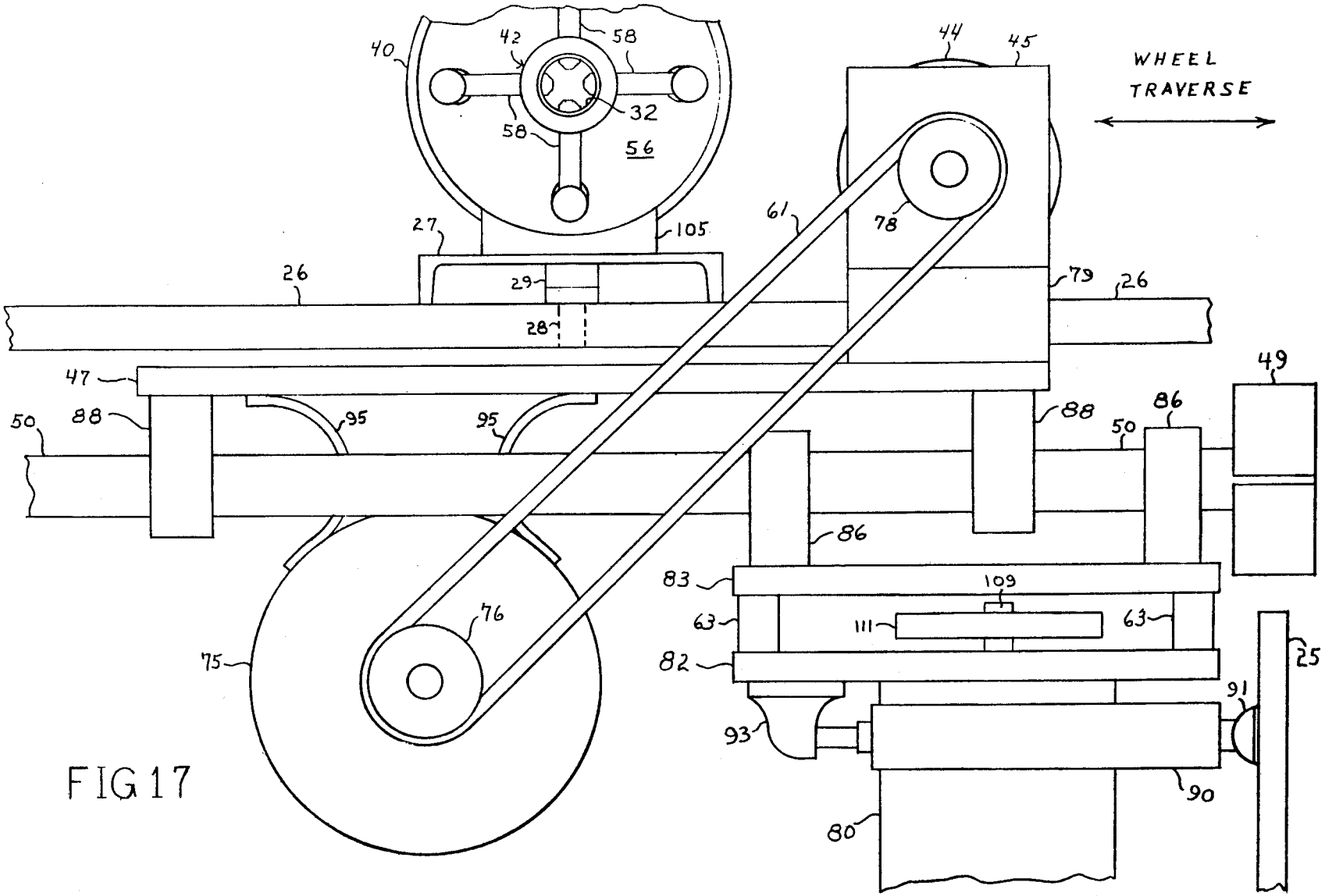
FIG. 17 is an enlarged fragmentary front elevational view of a portion of said machine.
Figure 18:
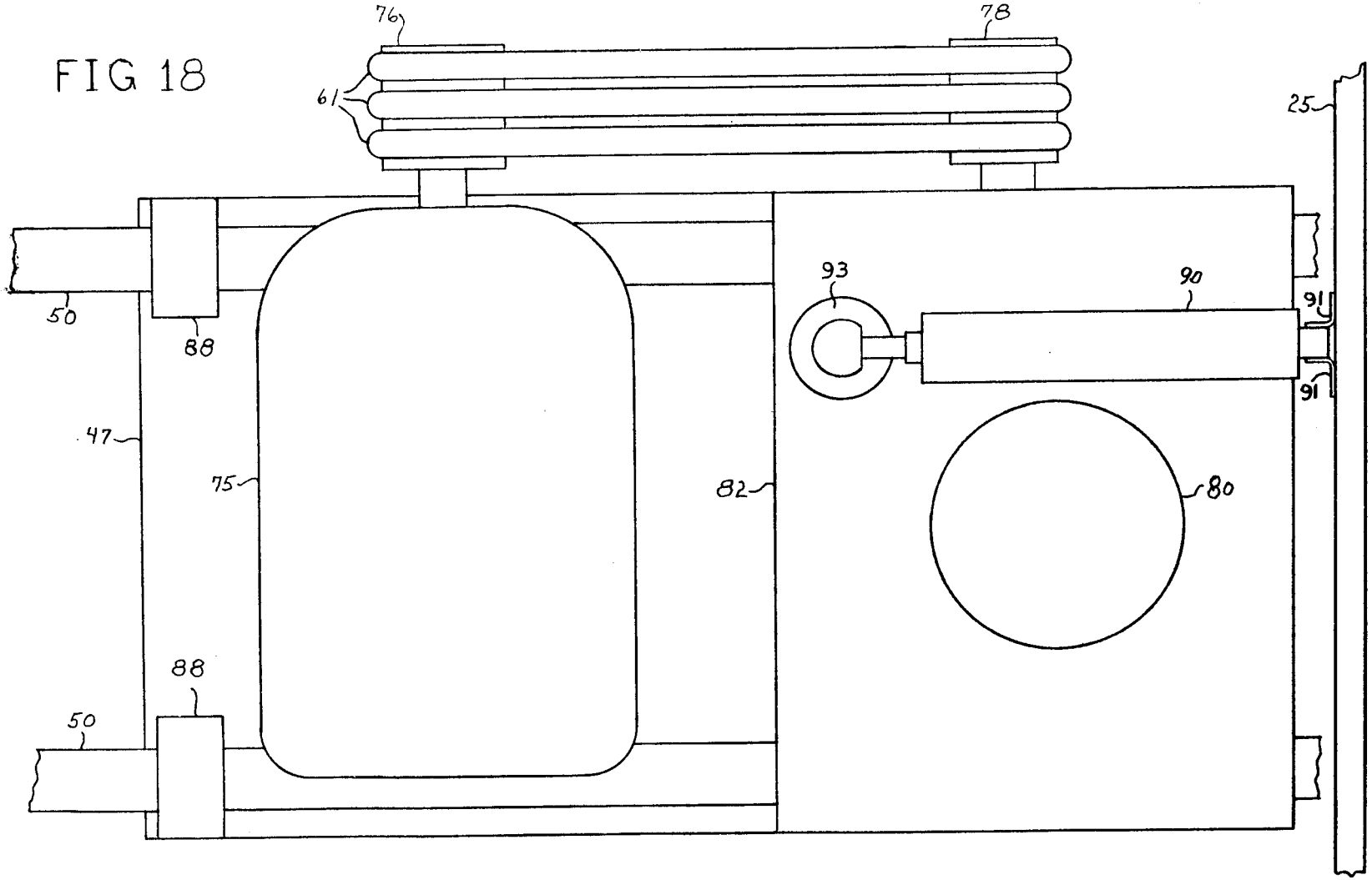
FIG. 18 is an enlarged bottom plan view of a portion of said machine.

The rotary drive shaft and motor for said grinding wheel 44 are designated 74 and 75 respectively (FIGS. 1 and 17). Flip-flop of the drill bit W occurs during in-feed thereof and during cyclic travel of the grinding wheel 44 as will be described. Timing is accomplished by a dual purpose cam as explained in Section "G" herein entitled: "Work Feed and Grinding Wheel Positioning System". Means for slowing and stopping this intermittent rotation of chuck 42 at a predetermined point is accomplished by two self contained hydraulic cushioning mechanisms 35 (FIGS. 1, 14, 15 and 16) mounted on opposite sides of the member 60. Each mechanism 35 is struck at each end of the rotary motion by a yoke 89 mounted on top of said member 60. The yoke 89 strikes a moveable hollow member 72 which is retractable inside of a stationary hollow member 65 affixed to a base plate 64 mounted on the plate 27. Hollow member 72 rests on piston 68 which operates against both a compression spring 67 and oil in the cavity 85 which work against the piston 68 bottoming out against a sleeve 66 disposed in the bottom of said member 65. Said spring 67 encircles a post 69 threadably carrying a fastener 71 which holds a splash plate 70. Said post 69 is provided with circumferentially spaced apart axial V-slots 59 which decrease in size as they extend downwardly of said post 69. During the energy absorbing stroke of said mechanism 35 oil in the spring cavity 85 is forced upwardly through said slots 59 and since the size of the latter decreases as the piston 68 descends, the speed of movement of said piston 68 is arrested down to acceptable limits as it approaches its bottoming out position. Such bottoming out position is determined by the physical stack-up of base 64, ring 66, piston 68, hollow member 72 and yoke 89. Said splash plate deflects the escaping oil to the sides of the upper chamber defined by the moveable member 72. Whatever oil, if any, seeps around the outside of the piston 68 is returned to the upper chamber via apertures 77 in the member 72; said apertures 77 moving below the annular chamfer around the top of the member 65 in the fully retracted position of said piston 68. Release of the pressure on the member 72 allows the spring 67 to return the piston 68 and member 72 to rest position and oil to return to the lower cavity 85. With reference to FIGS. 1, 2 and 3, the plate 27 is supported on an in-feed table 26 by four vertically adjustable feet 39 and moveable in an arc thereon via a pivot pin 28 held in the nose end 29 of said plate 27. The in-feed table 26 is in the form of a plate, as shown, of sufficient thickness and size to maintain the plate 27 and associated components including the chuck 42 in its proper position relative to the grinding wheel 44. Table 26 rests upon wear pads 87 supported on the frame plate 31. Plate 27 is both located and fastened at its rear end to said table 26 by means of a detent fitted in one of four detent apertures 81R,81L and 84R,84L formed in said table 26 on an arc designated G as shown. The pivot pin 28 is located on the axial center of the workpiece W to be sharpened. The significance of arc G and detent apertures, 81R,81L and 84R,84L is in relation to a predetermined included angle of geometry (or lip angle) of the workpiece W. Since one lip (a clearance face $W_A$ and its corresponding cutting edge $W_E$) is sharpened at a time the centerline C of the workpiece W is disposed at an angle Z to the centerline A which, for practical purposes, is used as a primary reference. The complement of angle Z; i.e., the angle between centerlines C and B, is exactly equal to one half of said predetermined angle. The most common or standard included angle is 118 degrees so that for this standard the complement of angle Z is 59 degrees; hence angle Z is 31 degrees. Some materials are more efficiently drilled by using a seconary standard for twist drills which is an included angle of 135 degrees.

These two options for Z; viz., 31 degrees and 22.5 degrees are provided by detent apertures 81R and 84R, respectively. The two detent apertures 81L and 84L provide these same respective angles on left-hand twist drills. Additional cutting lip angles can be accommodated by adding still other detent apertures in table 26 as required. Radical departures from these standard cutting lip angles (above or below) may require a revision of the curve in the grinding wheel profile.

The centerline A (FIG. 1) indicates the path of movement of the in-feed table 26; the centerline B the path of traverse of the grinding wheel 44; the centerline C the axial center both of the member 60 and of the drill bit W to be sharpened; the centerline D the vertical centerline of pivot pin 28; centerlines A, C and D are fixed in relation to said in-feed table 26 and their intersection point advances during the grinding sequence to intercept axis B at the completion thereof. The centerlines E and E' (FIG. 1) indicate the axial center of said rotary drive shaft 74 for said grinding wheel 44 at two extreme positions thereof. Centerline E indicates extreme left-hand travel of grinding wheel 44 (as viewed in FIG. 1) when it is cycling back and forth along axis B during a grinding operation. Centerline E' represents extreme right static position of grinding wheel 44 (as viewed in FIG. 1) during loading and unloading of workpiece W. There is an extreme right-hand travel of grinding wheel 44 (not shown in FIG. 1) in its cyclic movement which, in the instance, is approximately midway between axis A and E'.

Said work holding unit can be removed from the machine by first removing cylinder 104 and piston rod 106 as a unit (FIG. 21) (maintaining its hydraulic link to cylinder 102 intact), disconnecting the pneumatic lines and then lifting said work holding unit including the plate 27 from the in-feed table 26 which simplifies replacement and/or servicing.

C. WORKPIECE LOADING SYSTEM

Referring to FIGS. 5, 6, 12, 13, 25 and 26, said workpiece loading system includes a fixture into which a drill bit W is preloaded and the resultant assembly is inserted into the work holding chuck 42. Said fixture consists of an annular frame 53 and projecting yoke 57. The frame 53 is provided with locating apertures 41 which receive a locator pin 36 projecting from the nose of the chuck 42 for radially locating said fixture on said chuck 42. The yoke 57 carries an adjusting screw 43 having on the inner end thereof a locating pad 112 for bearing against the point $W_P$ of the drill bit W. A pair of overlapping spring fingers 46 are held on said yoke 57 by clamps 48 so that as a drill bit W enters the fixture it is automatically rotated radially and held in place against the locating pad 112 by said spring fingers 46; said spring fingers 46 operating upon the two cutting edges $W_E$. Thus said fixture insures that the end of the drill bit W to be sharpened is precisely located in respect to the chuck 42 radially so that said edges $W_E$ thereof are parallel to axis B and so that the point $W_P$ thereof will coincide with the intersection of axes A, C and D; this precise locating and orientation of the drill bit W occurs in every case irrespective of the length or diameter thereof. When the drill bit W is clamped in chuck 42 the loading fixture is removed from the front end of the latter.

D. GRINDING CARRIAGE SYSTEM

Referring to FIGS. 2, 3, 17 and 18, said carriage system or oscillating grinding wheel assembly is composed of two interconnected sub-carriages mounted on two common rails 50 disposed at right angles to the in-feed motion. One sub-carriage includes plates 82, 83 support blocks 63 and an electrical motor 80. The other includes a companion sub-carriage including plate 47 for moving the grinding wheel 44 across each face $W_A$ of the drill bit W to be sharpened. Linear ball bearings and their housings 86 are used to hang the sub-carriage 82, 83 on the common rails 50.

The sub-carriage 47 includes an electrical motor 75 held by brackets 95 and a spindle housing 45 and spindle 74 for the grinding wheel 44. Appropriate pulleys 76, 78 and belts 61 transmit the drive from the motor 75 to the spindle 74. Linear ball bearings and their housings 88 support this sub-carriage 47 on the common rails 50. The sub-carriage 82, 83 is tied to a fixed point on the common rails 50 by brackets 91, 93 and a pneumatic cylinder 90 which is actuated automatically at the end of each grinding sequence to move both subcarriages 82, 83 and 47 from grinding position. This allows manual unloading of a workpiece and loading of another. Said two sub-carriages 47 and 82, 83 are interconnected through a conventional oscillating mechanism (not shown) driven by the motor 80 through a gear train disposed between the plates 82, 83 and including drive gear 111 made fast to the shaft 109 of said motor 80 and a crank (not shown) which operates between two rails (not shown) on the underside of the plate 47 for moving the latter back and forth during operation of said motor 80. The latter is de-energized whenever positioning cylinder 90 is retracted; whenever positioning cylinder 90 is extended, the motor 80 is immediately energized.

Actuation of said cylinder 90 to move the carriage unit into grinding position is accomplished by a manual control valve (not shown) in the pneumatic system. This valve will not perform its function unless the workpiece clamping action has been completed. A second manual valve (not shown) operates the clamping cylinder 38 and sends air pressure into the system but only so far as to said first-mentioned manual valve which controls both cylinder 90 and a positioning cylinder 102.

Figure 19:
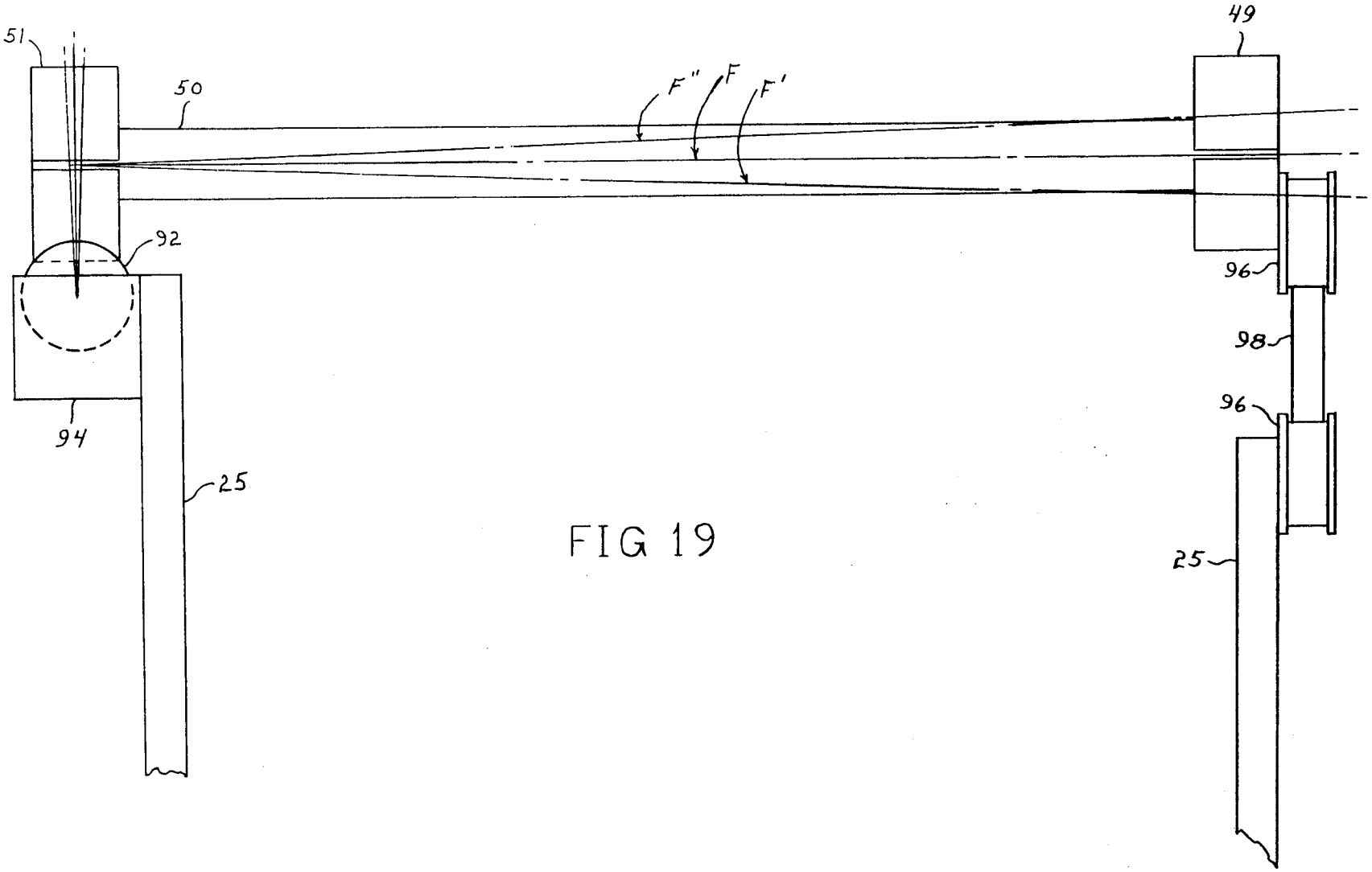
FIGS. 19 and 20 are, respectively, front and fragmentary side elevational views of the grinding wheel elevating mechanism of said machine.
Figure 20:
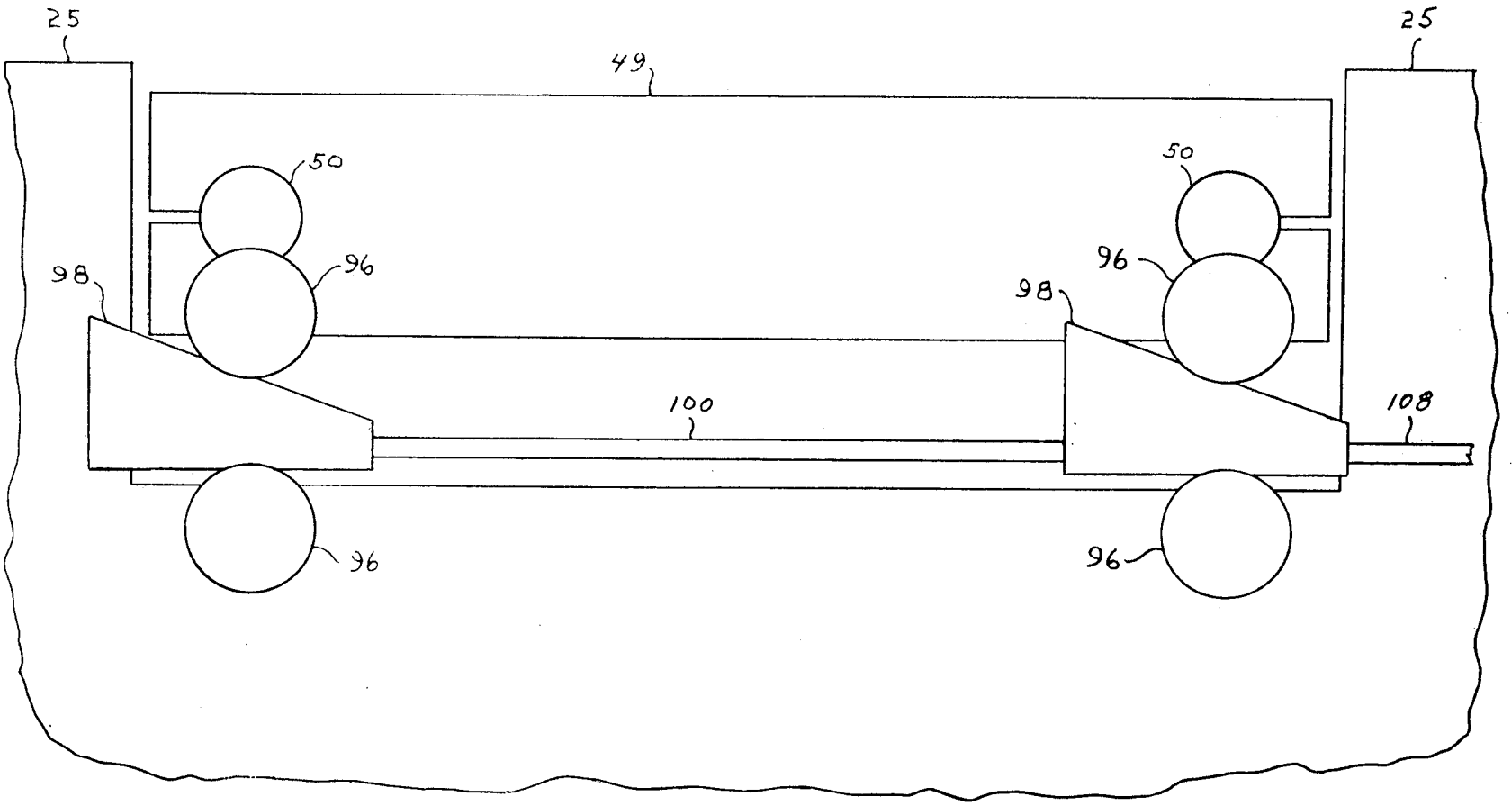
Figure 21:
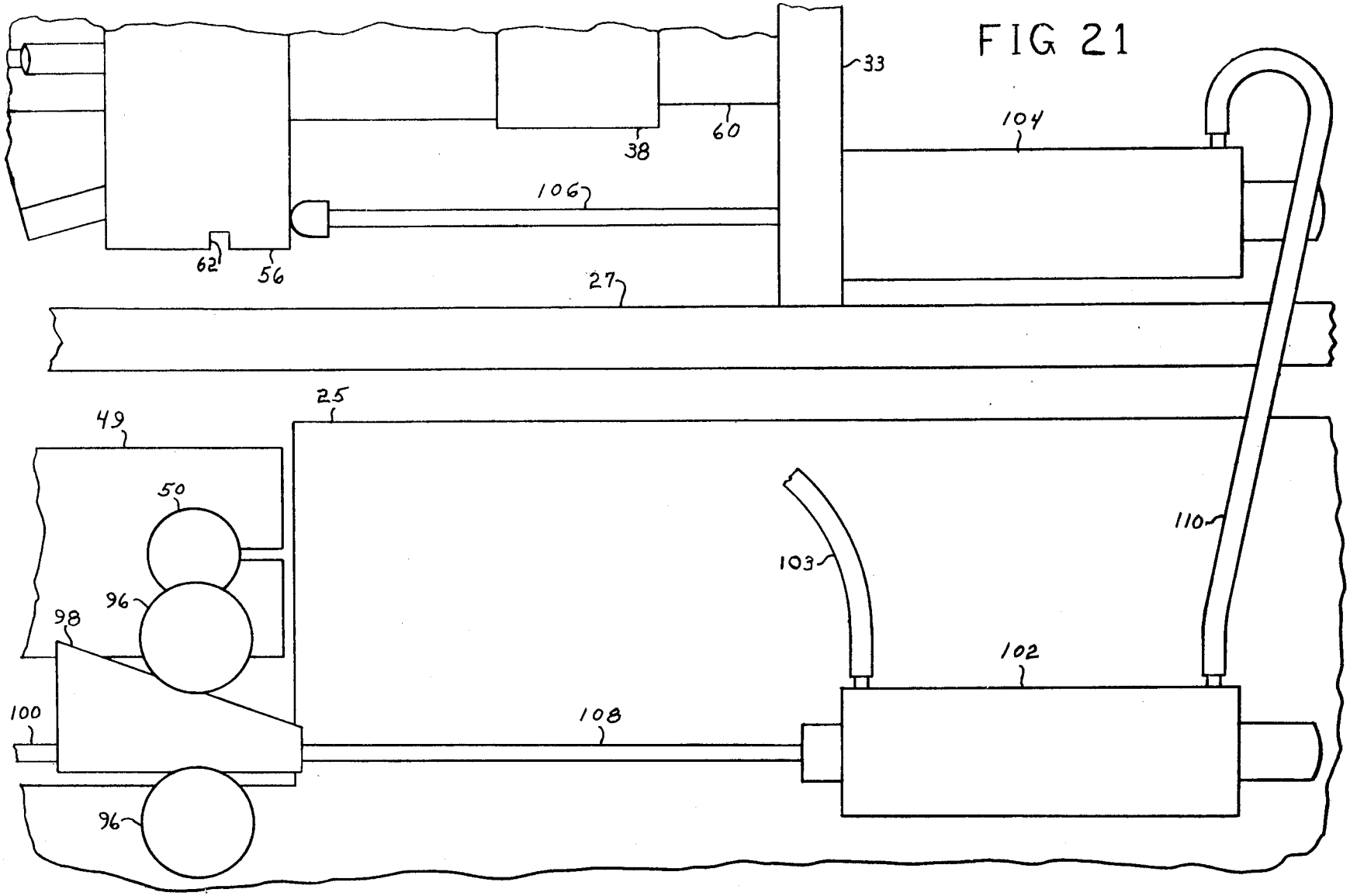
FIG. 21 is another fragmentary side elevational view of another portion of said elevating mechanism.
Figure 22:
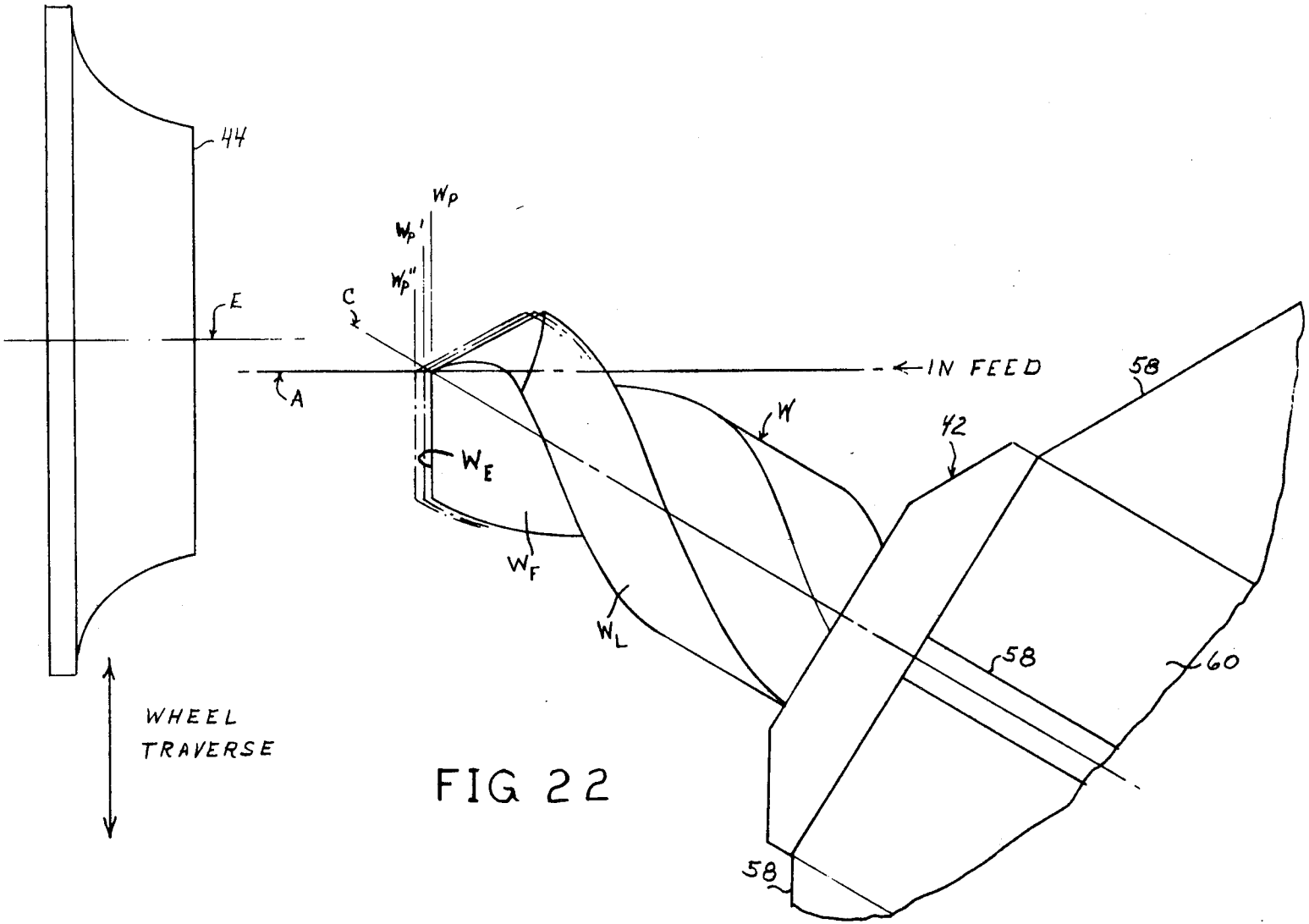
FIGS. 22 and 23 are, respectively, top plan and side elevational views of the grinding wheel of said machine shown in relationship to twist drills to be sharpened.

The two common rails 50 are held between support members 49 and 51 at opposite ends thereof, respectively (FIGS. 19, 20 and 21). The support member 49 is disposed above the right-hand side of the frame 25 while the support member 51 is supported outside of the frame 25 on a pair of short stub shafts 92 which are made fast to members 94. The members 94, in turn, are made fast to the outside of said frame 25. The left-hand side 51 of the common rails 50 is hinged by means of the stub shafts 92; the underside of the member 51 being cylindrically grooves at two spaced apart areas thereon corresponding to the location of the two stub shafts 92. The right-hand end 49 of the common rails 50 is vertically moveable about said hinge in order to present different areas of the grinding wheel 44 to each drill face $W_A$ for various diameter drill bits. Guide members 96 are made fast to the support member 49 and to the frame 25; wedge members 98, being part of a cam and riser rod device 98, 100, 108 move between said guide members 96 for raising and lowering of the member 49 as will be described. The top surfaces of wedge members 98 are shown as straight lines (FIGS. 20, 21); however each said surface is actually a generated curve coordinated to present the correct section of the grinding wheel profile to the workpiece W in accordance with the drill size of the drill bit W being sharpened. Said generated curve is a composite of discrete heights for each wedge 98 corresponding respectively to the different drill bits W to be sharpened when properly positioned on the profile of said grinding wheel 44. For the larger size drill bits the curvature at the lower end of each wedge 98 is used while for the smaller size drill bits that at the higher end thereof is used. The rate of change of such curvature is greater at the lower end of each wedge and decreases as the same is ascended.

The complete carriage assembly including the two sub-carriages 47 and 82, 83 and the two rails 50 may be removed after disconnecting positioning cylinder 90 and the pneumatic and electrical lines for ease of maintenance and/or replacement.

E. THE PNEUMATIC SYSTEM

This system consists of known state of the art components such as valves (1, 2, 3 and 4 way); cylinders (single and double); manifolds; pressure switches; oilers; filters; regulators and their interconnecting hoses and tubes.

Four manual pneumatic controls are provided:

1. Clamping valve for actuating the workpiece clamping cylinder
2. Grinding cycle valve for actuation of the grinding sequence
3. "Panic" stop valve for immediately stopping the grinding sequence
4. Jog button valve for opening the chuck jaws.

All other valve and cylinder actions are automatic.

F. ELECTRICAL SYSTEM

The two electrical motors 75 and 80 of said machine are fractional horsepower units and are activated through a simple line switch. The spindle drive motor 75 is intended to run continuously. The carriage oscillating drive motor 80 runs intermittently as determined by the pressure switch action interposed in that power line inside the machine.

G. WORK FEED AND GRINDING WHEEL POSITIONING SYSTEM

The in-feed table 26 (FIG. 1) is moveable fore and aft of the base 25 by a conventional mechanism (not shown) affixed to the underside of the plate 31 including a feed screw (not shown) rotated by a pneumatic device (not shown) controlled by the previously mentioned dual purpose cam driven by the gear train (including gear 111) of the oscillating motor 80. Maximum in-feed allowed for the workpiece W is 0.125" which is many times the movement necessary for normal sharpening (approximately 0.010" to 0.020"). Incremental in-feed of the workpart W in respect to the grinding wheel 44 is shown and indicated by the sets of lines $W_P$, $W_P'$ and $W_P''$ in FIG. 22.

During in-feed of the workpiece W the rotation of the feed screw is extending the piston of an in-feed return cylinder (not shown). At the completion of the grinding sequence the in-feed table 26 actuates a limit valve (not shown) affixed to the base 25 and the following actions automatically occur:

1. Grinding carriage retracts
2. Oscillating motor stops
3. Feed table retracts to start position.

Control of the amount of in-feed movement less than complete total in-feed (one complete revolution of the feed screw) is accomplished by interposing a manually insertable wedge (not shown) between a detent (not shown) carried by the in-feed table and said limit valve that starts the final actions described above; the use of said wedge makes such control nearly infinitely variable.

The presentation of the proper curve of the grinding wheel to the drill face is predicated on the position of the sliding sleeve 56 of the work holding device (FIGS. 20 and 21). For a given diameter drill bit, the sliding sleeve 56 is always in the same relative position (fore and aft of said machine). A piston rod 106 of a double acting positioning cylinder 104 has been placed against the rear face of the sliding sleeve 56 so that any movement of said sleeve 56 will move the piston 106 a like amount. From the rear part of said cylinder 104 beyond the piston an hydraulic connection 110 has been established to a companion identical cylinder and piston unit 102 having a piston rod 108. The pressure source for said cylinders 102 and 104 is pneumatic, as at 103, and all passageways including hose 110 on the rear side of the cylinders 102 and 104 have been filled with hydraulic fluid so that any movement of the sliding sleeve 56 will be accompanied by an equal and identical movement of piston rod 106 and hence of piston rod 108 which is connected to cams 98 via a riser rod 100 so as to separate or bring together the guide bearings 96 which control the raising and lowering of the hinged carriage system and of the grinding wheel 44 whereby to present the proper curve on the profile thereof to each clearance face $W_A$ of the particular drill bit W being sharpened.

The in-feed table, after removal of the work holding system, may be lifted directly from the machine, again minimizing maintenance and/or replacement problems.

Operation:

The machine is prepared for use by making two connections to existing sources of supply, viz., electrical and pneumatic.

1. Electrical

A standard three prong plug for plugging into a standard outlet is supplied and attached to the machine. Voltage required is standard 110 volts A.C. in this instance. The line voltage is fed to the electrical components of the machine through a standard line switch (not shown) which, when actuated on "ON" position immediately activates electrical motor 75 and, through pulleys 76, 78 and belt 61, turns spindle shaft 74 and grinding wheel 44. The relative position of motor 75 and spindle 74 is constant (FIG. 17). Grinding wheel 44 is rotating at all times that the line switch is "ON" Electric power is also supplied to oscillating motor 80 through this same line switch. Motor 80 also incorporates an integral electric brake (not shown). When cylinder 90 retracts the carriage system 47 and 82, 83 to E' position (FIG. 1) for loading the workpiece W, a pneumatically operated micro switch (not shown) switches the electric power from motor 80 to its integral electric brake stopping all activity of the machine (except the rotation of the grinding wheel 44). The purpose of this interruption is to provide a stable condition for the loading and unloading of the workpiece W.

2. Pneumatic

A standard "quick disconnect" pneumatic fitting (not shown) is attached to the base 25 to allow connection with a standard shop air supply of approximately 100 psi. From this standard fitting the air line (not shown) attached to the machine leads through an air filter (not shown), oiler (not shown) and pressure regulator (not shown) to a manifold (not shown). From this manifold, air pressure is fed to all pneumatic components through appropriate valves (all standard). Individual pneumatic action will be explained as the description proceeds through the sequence of operations of said machine. Air pressure required for machine operation is regulated to approximately 70 psi. With the machine in readiness to perform its functions, one can now select the workpiece which may be of any size (diameter) within the machine's predetermined range (⅛" diameter to 1.0" diameter inclusive, in this instance) and any length. Since the design parameters of the machine were all predicated on the standard two lip straight shank twist drill, the workpiece W will be assumed to be of this configuration.

Referring to FIGS. 5, 6, 25 and 26, the workpiece W is fitted into the loading fixture 53, 57 with the existing point $W_P$ coming to a stop against pad 112. As the workpiece W is inserted into the fixture 53, 57, the spring steel fingers 46 engage the cutting lips $W_E$ of the workpiece W and align these lips in the proper relation to cavity 41 which, in turn, engages pin 36 located on the nose of the chuck 42. The pad 112 and fingers 46 have now placed the workpiece W in the proper position for the loading action.

The workpiece W is held horizontally with the temporarily attached loading fixture 53, 57 and inserted (shank end first) into the cavity 32 of chuck 42. As the loading device meshes with the nose of the chuck 42, a slight rotation will align cavity 41 with pin 36 and the workpiece W location is completed.

Figure 11:
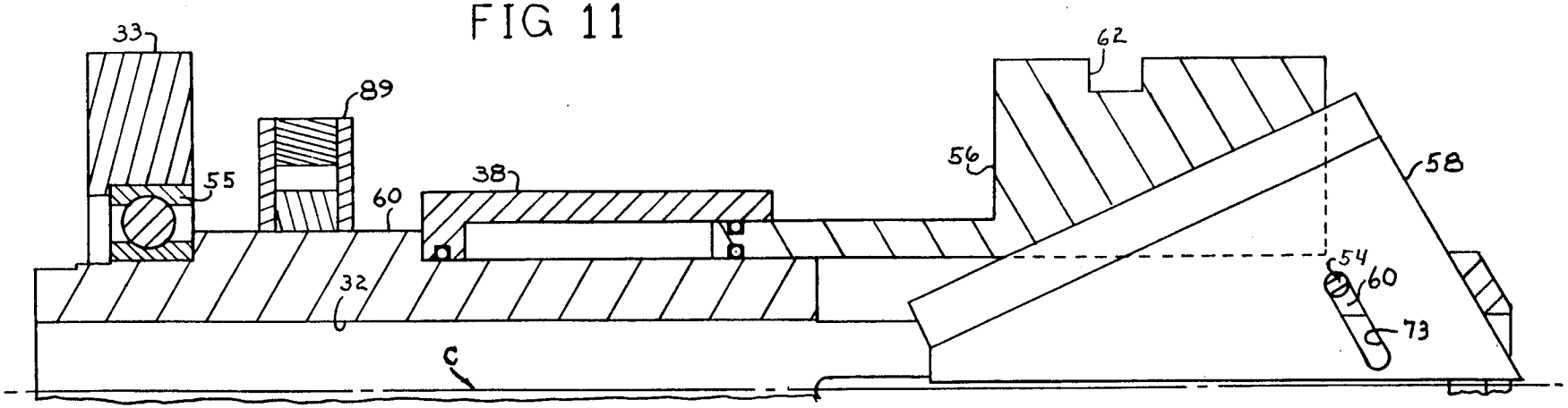
FIGS. 10 and 11 are respective fragmentary vertical sectional views of the upper and lower halves of the chunk mechanism of said machine shown in different operative positions thereof.
Figure 10:
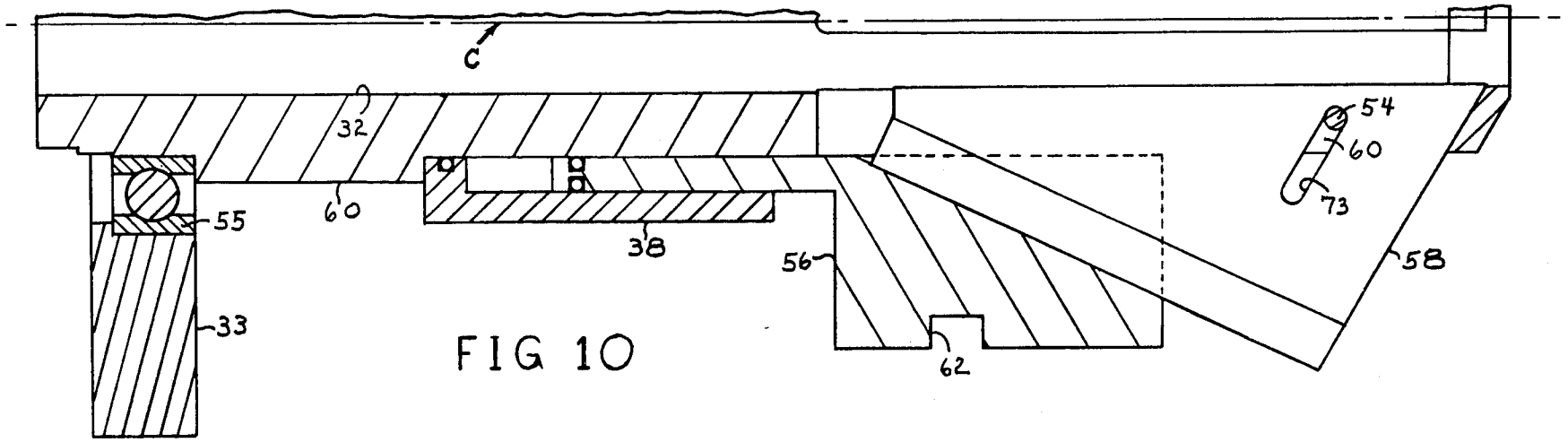
Figure 12:
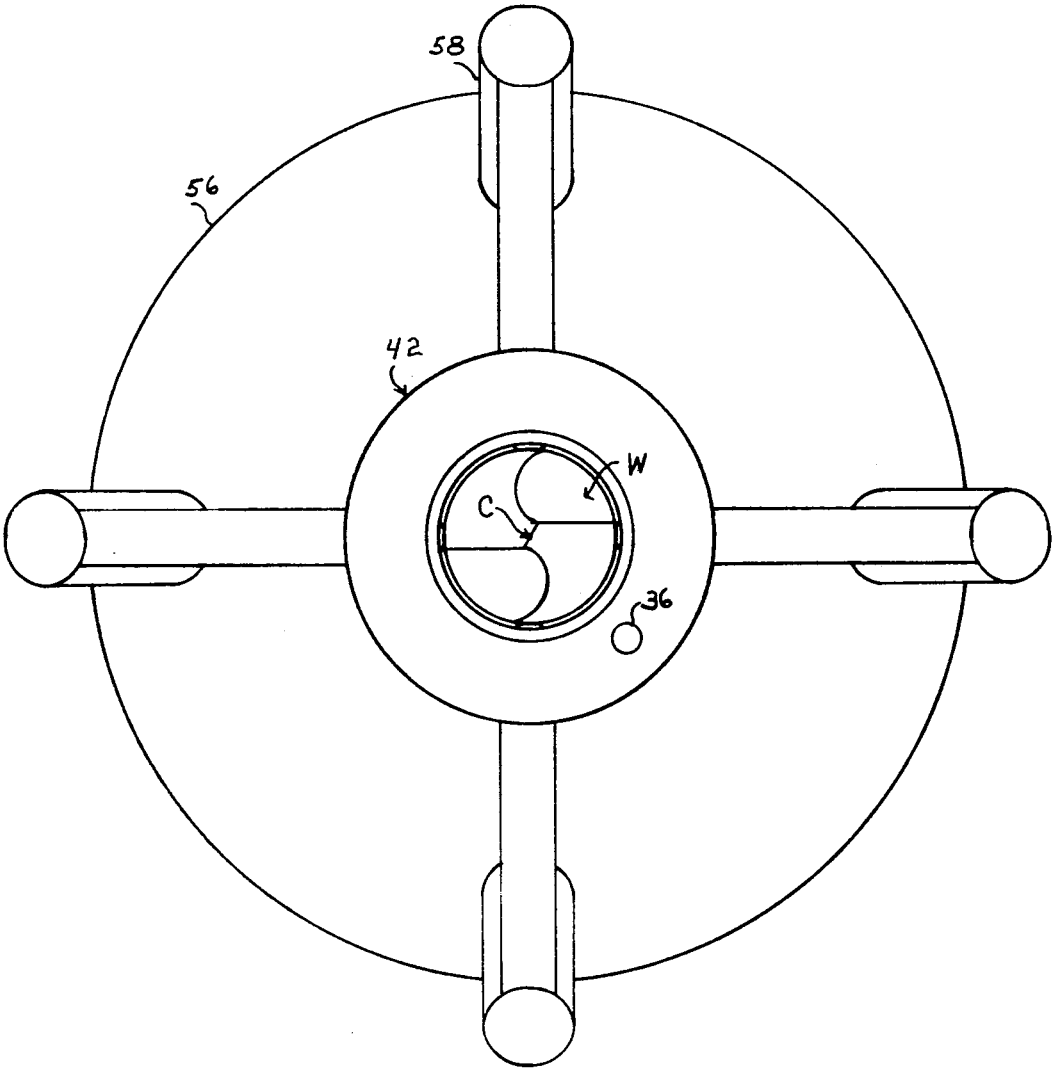
FIGS. 12 and 13 are respective front elevational views of said chuck mechanism showing the same in different closed positions thereof holding different diameter twist drills.
Figure 13:
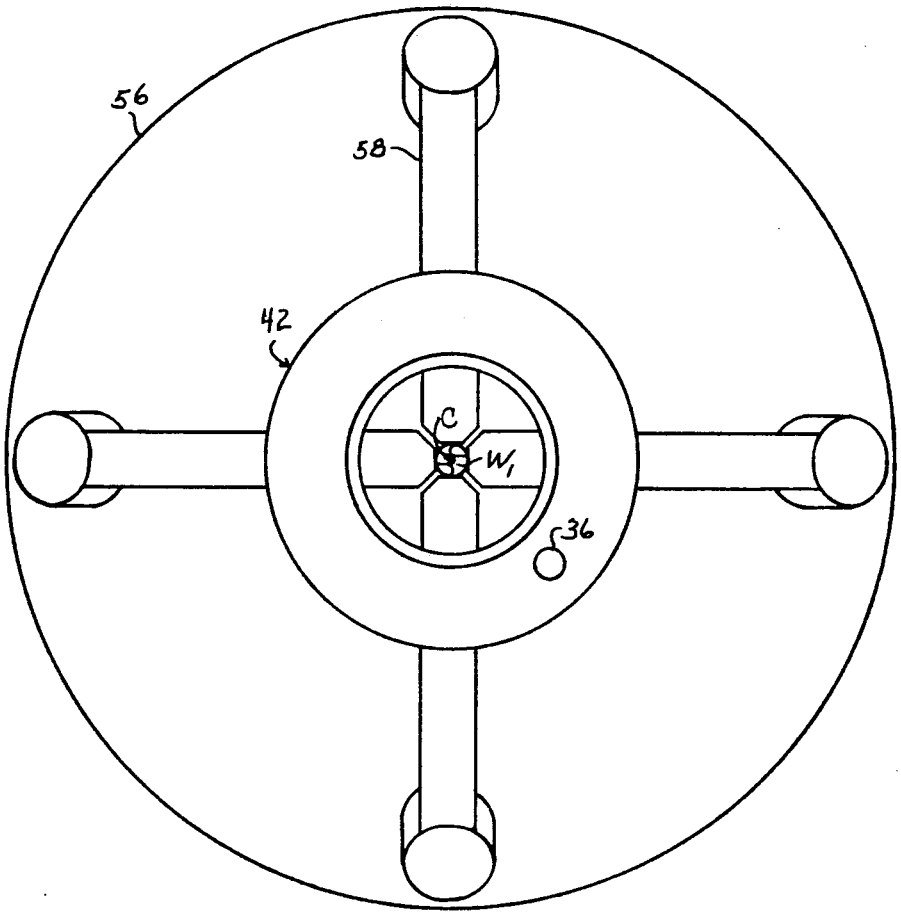
Figure 14:
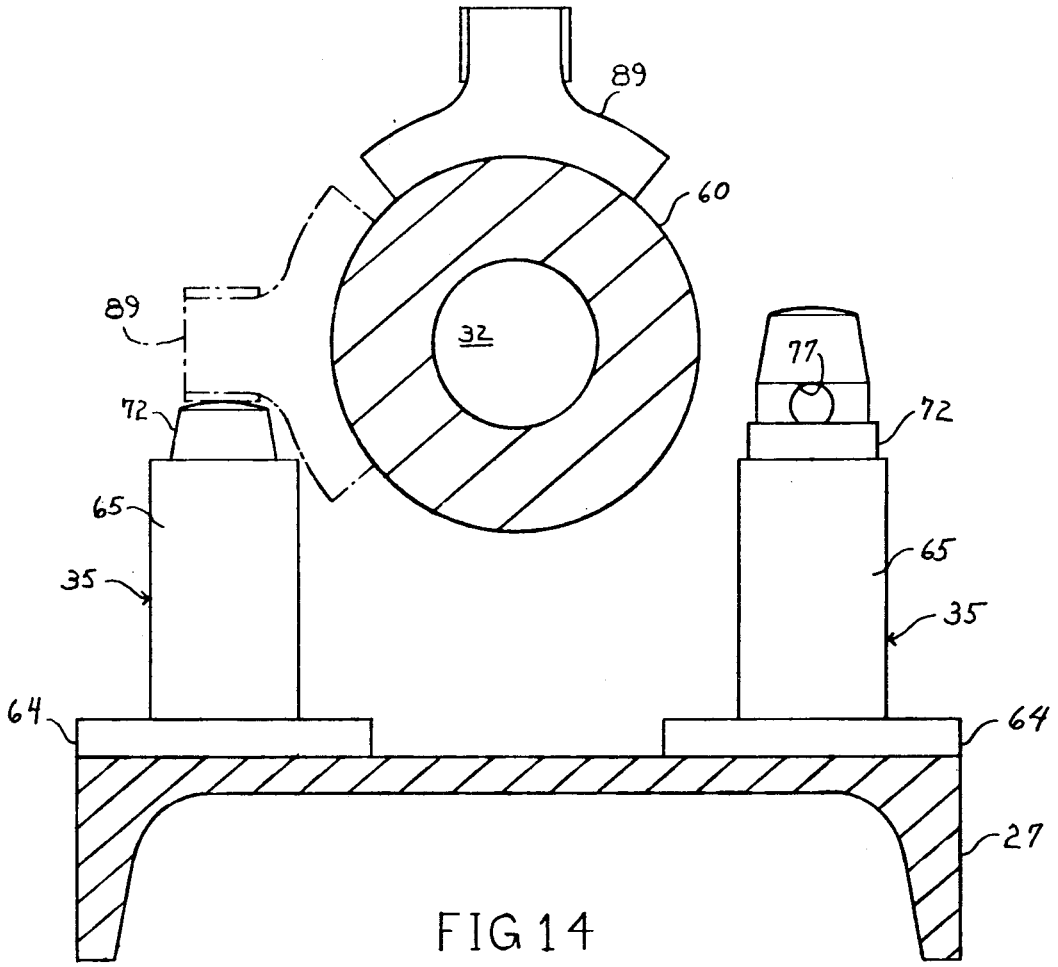
FIGS. 14 and 15 are respective vertical sectional views with parts in elevational of the cushioning device of said machine.
Figure 15:
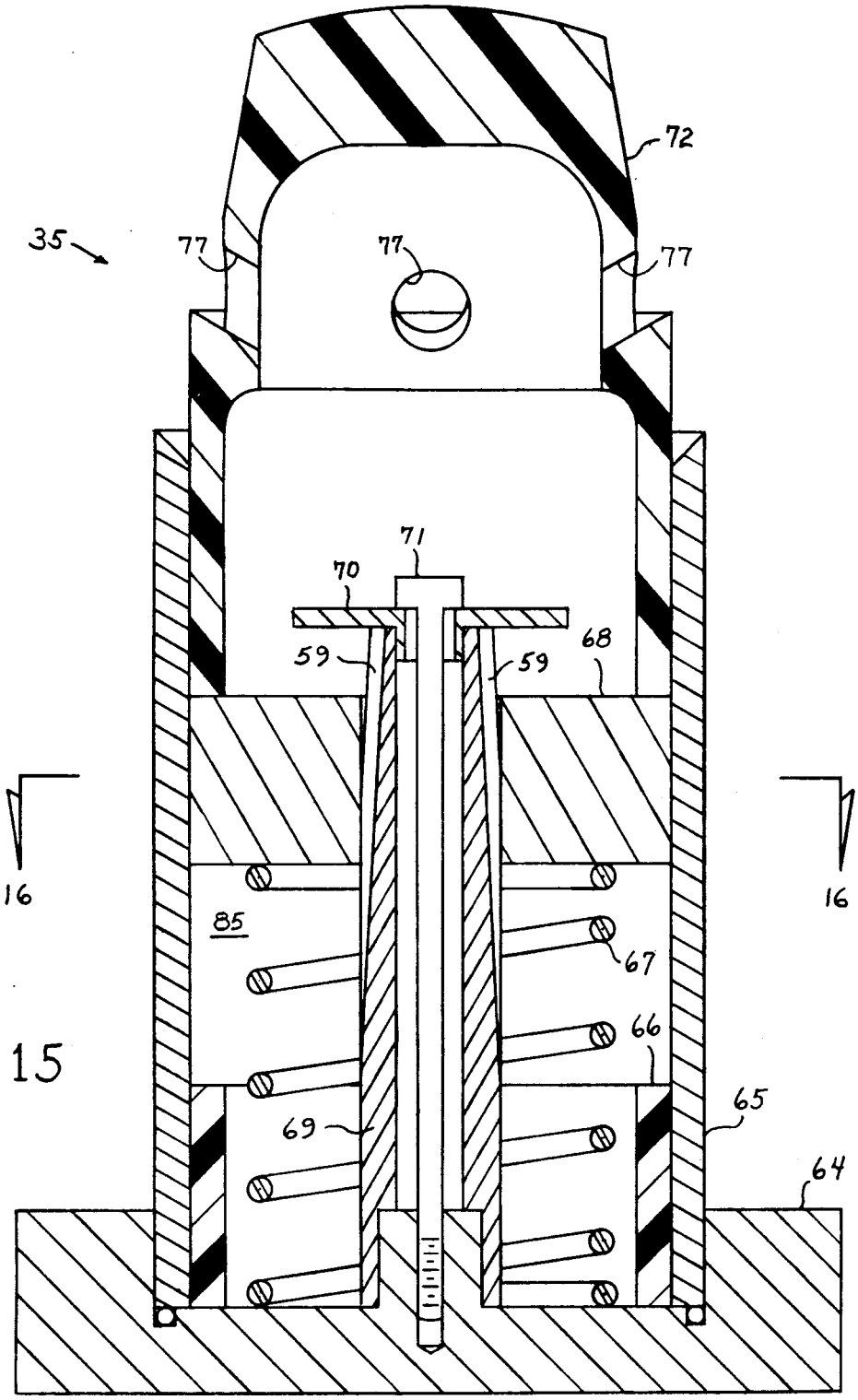
Figure 16:
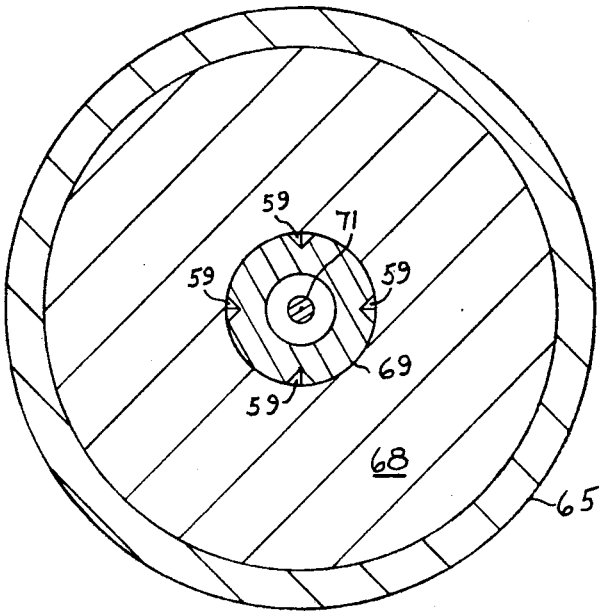
FIG. 16 is a horizontal sectional view of the structure of FIG. 15 taken on the line 16—16 thereof.

With the workpiece W and loading fixture 53, 57 held firmly against the nose of the chuck 42 and pin 36 engaged in cavity 41, said manually operated two-way pneumatic clamping valve is activated to allow air pressure into the cylinder 38 (FIGS. 10 and 11). This forces clamping ring 56 toward the nose of the chuck 42 causing the blades 58 to progress towards centerline C on a path dictated by pins 54 and cavities 73. This action continues until blades 58 meet the workpiece W and clamp it rigidly in the position dictated by the loading fixture 53, 57. At this time, the loading fixture 53, 57 is manually removed from the workpiece W and placed aside. During the grinding cycle, pressure is maintained in the cylinder 38 against the extended portion of clamping ring 56 to firmly hold the workpiece W in position. The offset mounting of the torque motor 101 (FIG. 1) allows unobstructed loading, as mentioned, of any length workpiece W through cavity 32 of chuck 42.

Actuating said clamping valve that activates the clamping of the workpiece W also directs pneumatic pressure to said manually operated one-way pneumatic grinding cycle valve which will start the automatic grinding cycle by directing pneumatic pressure to cylinder 90 which extends the grinding carriage system. These two manually actuated pneumatic valves (clamping and start grinding cycle valves) must be operated in this sequence: first, the clamping valve and then the start grinding cycle valve. The grinding cycle valve will not respond until the clamping valve is first activated.

As the grinding cycle valve is activated the following actions take place sequentially: cylinder 90 extends the carriage system 47 and 82, 83 into grinding position. This motion releases the micro switch that has routed electric power to the integral brake of motor 80 and now reserves this routing to release the integral brake and start the rotation of motor 80. Drive gear 111 separately drives the previously mentioned crank and dual purpose cam. Rotation of the crank causes the carriage 47 to cycle back and forth on rails 50. The position of carriage 82, 83 as determined by the extension of cylinder 90, is such that the back and forth motion of carriage 47 carries the grinding wheel 44 back and forth along grinding axis B (FIG. 1).

The rotation (rpm) of said dual purpose cam is timed to be exactly 50% of the rotation (rpm) of the crank. Through each half travel (180 degrees) of the dual purpose cam a two-way spring-loaded valve (not shown; affixed to carriage 82, 83) is alternately opened and closed so that pneumatic pressure is directed alternately to opposite sides of the air torque motor 101 to cause its shaft to flip flop through 100 degrees of rotational travel. Through suitable gearing, including drive gear 99 and driven gear 97, the air torque motor 101 rotates chuck 42 through 180 degree arcs of travel as dictated by the rotation of said dual purpose cam. Once (for approximately 5 degrees) through each full travel (360 degrees) of said dual purpose cam a second two-way spring-loaded valve (not shown; affixed to carriage 82, 83) is actuated so that pneumatic pressure is directed to said conventional mechanism for rotating said feed screw to cause incremental in-feed of said workpiece W. Thus, simultaneous in-feed of the workpiece W and flip flop thereof occur followed by flip flop thereof without in-feed. This sequence of incremental in-feed of the workpiece W for every other 180 degrees rotation of the chuck 42 occurs during maximum in-feed or whatever fraction thereof the operator selects for the particular drill bit W being sharpened.

To describe the in-feed movement of the workpiece W in relation to the travel of the grinding wheel 44, I shall cover two complete cycles of the latter. Assuming that the grinding wheel 44 is moving out of left-hand extreme grinding position E then, as it approximately passes across axis A, simultaneous in-feed of table 26 and flip flop of chuck 42 with workpiece W commences. As the grinding wheel 44 reaches and passes through right-hand extreme grinding position, then as it approximately passes from right to left across axis A again, the simultaneous in-feed and flip of the workpiece W have been completed. This consumes approximately 70% of the cyclic travel of the grinding wheel 44. As the grinding wheel 44 continues its travel from axis A and reaches and passes through left-hand extreme position E the grinding wheel 44 is performing a grinding function on a clearance face $W_A$ of the workpiece W while the latter is being held completely stationary. This consumes approximately 30% of the cyclic travel of the grinding wheel 44. The movement of the grinding wheel 44 across axis A from left to right for the second time commences the second cycle of said grinding wheel 44. During the remaining part of this second cycle, as the grinding wheel 44 reaches and passes through right-hand extreme position, chuck 42 with workpiece W is oppositely flipped (but this time without any in-feed) to present the other clearance face $W_A$ of the workpiece W to the grinding wheel 44. As the grinding wheel 44 passes through axis A from right to left the workpiece W is again held completely stationary and a grinding operation commences on said other clearance face $W_A$ and continues while grinding wheel 44 moves into and out of extreme left-hand position E. (The second cycle of grinding wheel 44 is completed when it leaves workpiece W and passes across axis A). Thus, at least two passes of the grinding wheel 44 are made across each clearance face $W_A$ of each workpiece W. More than the minimum of two such passes are made for each clearance face $W_A$ depending upon the amount of sharpening the workpiece W requires as determined by the operator's positioning of said wedge.

Whether or not the foregoing described grinding operations are taking place, the foregoing described sequences of in-feed of the workpiece W and its flip flop, together with the cyclic travel of the grinding wheel 44, nevertheless occur and do so as soon as the grinding cycle valve is actuated. If no workpiece W is present in the clamping device 42 no damage can occur to the grinding wheel 44 or to said clamping device 42 because the predetermined maximum in-feed of the in-feed table 26 is arranged so that there is always clearance along axis A between the clamping device 42 and the grinding wheel 44.

Referring to FIGS. 10, 14, 15 and 16, the 180 degree arcs of travel of chuck 42 are limited by shock absorbers 35. Yoke 89 will impinge on pad 72 of shock absorber 35 during approximately the last ten percent of its rotational travel. Orifices 59 allow oil from cavity 85 to escape in a decreasing volume as pad 72 and piston 68 are forced downward. This pattern provides a slowing tendency to the rotational inertia of chuck 42 and, at the end of the stroke of pad 82 and piston 68, the mechanical stack up of parts 64, 66, 68, 72 and 89 will stop the rotational travel of chuck 42 at exactly 180 degrees from start position. This completes the description of the two purposes of the dual purpose cam, i.e. to actuate said conventional mechanism to cause in-feed of the in-feed table 26 and to direct pneumatic pressure to the said torque motor 101 to cause chuck 42 to flip flop the workpiece W as described.

Actuation of said grinding cycle valve also supplies air flow through hose 103 to the cylinder 102 (FIGS. 20 and 21). Air pressure through hose 103 to the cylinder 102 is constant throughout the grinding cycle. Start position of the cylinder 102 is with its piston rod 108 and attachments 98, 100 fully extended. Application of air pressure through hose 103 starts retraction of piston rod 108 and its attached cams 98 and rod 100 which causes further separation of guide rollers 96; this action is limited by the interaction of the hydraulic link 110 and the extension of piston rod 106 bearing against the clamping ring 56. This separating action of the guide rollers 96 causes pivotal movement of support members 51 and the common rails 50 (as illustrated in FIG. 19 by the sets of centerlines, as at F, F′, F″) and results in raising and lowering of the grinding wheel 44. Therefore, the position of the hinge assembly 96, 49, 50, 51 (F, F′, F″) is determined by the axial position of the clamping ring 56 which, in turn, is determined by the diameter of the workpiece W. Since the grinding carriage 47 rides on rails 50, the relative position of rails 50 (F, F′, F″) dictates the vertical position of grinding carriage 47 and its attachments which include grinding wheel 44. By this arrangement the particular part of the profile of grinding wheel 44 is maintained in the correct vertical position to impart the proper clearance face $W_A$ on the drill bit W during sharpening thereof. Tripping of said pneumatic limit switch represents the completion of the grinding cycle and, through appropriate pneumatic equipment, the following actions take place: (1) the in-feed action is reversed through the aforementioned conventional mechanism and table 26 is returned to start position; (2) air pressure is released from hose 103 and cylinder 102 providing a static "at rest" condition; (3) upon tripping of said pneumatic limit switch air pressure is switched from the extension end of cylinder 90 to the retraction end of cylinder 90 which pulls the carriages 47 and 82, 83 into load (or unload) position (centerline E′). Said retraction trips said micro switch re-routing electric power from motor 80 to its integral electric brake.

At this point all functions and actions that were started with the activation of the said grinding cycle valve are complete; all within an elapsed time of approximately 60 seconds.

The manually operated pneumatic valve that introduced air pressure to cylinder 38 is manually deactivated which relieves air pressure from all active pneumatic components except cylinder 90.

Air pressure is now introduced through said jog button valve to cylinders 30 causing them to retract in tandem with their detents 37. Retraction of the piston rods of cylinders 30 moves clamping ring 56 aft causing blades 58 to move away from the workpiece W thereby releasing the latter for manual unloading.

This movement of clamp ring 56 also causes retraction of piston rod 106 into cylinder 104 and, through the hydraulic link to cylinder 102, causes an equal extension of piston rod 108 and its attached cams 98 and rod 100. The exact amount of movements of the involved components is not critical. The only concern is to provide adequate opening of blades 58 in chuck 42 to allow loading of the subsequent workpiece.

It will thus be seen that there has been provided by my invention an improved twist drill sharpening machine in which the object hereinabove set forth, together with many thoroughly practical advantages, has been successfully achieved. For example:

1. Simplified construction for optimum service and maintenance.

All primary working systems, i.e. B-Workpiece Holding System, D-Grinding Carriage System, G-Work Feed and Grinding Wheel Positioning System are designed substantially integral so that, after disconnecting applicable pneumatic, hydraulic and/or electrical connections, these integral systems may be lifted bodily from the machine base and either be replaced with identical integral systems or transported to a service center for maintenance. In this manner both the maintenance and operating effectiveness (time) of my machine are improved.

2. Capability of providing industry standard geometry without machine adjustment.

The working profile of the grinding wheel 44 imparts a standard geometry on every drill size (diameter) in the designed range of my machine and the wheel positioning feature is controlled and dictated by each particular drill size (diameter) automatically.

3. No wheel dressing required.

The grinding wheel 44 is nearly permanent in that it maintains a substantially constant working profile. The plated matrix and grit compound deposited on the working profile is renewable as required by stripping and replating.

4. Minimal operator participation.

The loading and unloading of drill bits are manual functions requiring minimal dexterity. Operator judgement is required in only one instance; viz., initial determination of the amount of total in-feed required to sharpen the given drill bit based upon its present wear condition; the less wear, the less sharpening required and therefore a smaller total in-feed and vice versa for a greater worn drill bit.

5. No clamping adjustment for any diameter drill bit within the designed range of my machine.

6. No adjustment required for any length drill bit and no limit on length of drill bit that can be handled by my machine.

7. Drill bit position and registration determined by the existing drill bit point.

Constantly differing diameters and lengths that are typical of drill re-sharpening activity present no problem with my machine as the present point of the drill bit W to be sharpened (point $W_P$ and cutting edges $W_E$) is used to position said drill bit W in chuck 42.

8. Simplified accommodation for different included angles of drill bit points.

The integral workpiece clamping system has the capability of pivoting around a predetermined pivot point so that by disposing the drill bit at differing predetermined angles relative to the grinding axis, several different geometries may be imparted to the drill bit, both right-hand and left-hand.

A wide variety of drill cross sections for the working end of two lip twist drills are encountered in industry, e.g., those with smooth lands, those with clearance along the trailing portions of the lands, those with smooth flutes and those with irregular surfaced or grooved flutes. My machine, as presently shown, is capable of sharpening all of these varieties without any modification whatever.

It will be evident to those acquainted with the art, that the structure and functions of my invention can be accomplished with a variety of configurations or arrangements other than that shown and described. For example, my machine may be adapted to completely automatic operation including loading and unloading of workpieces W, particularly where large quantities of identical diameter workpieces W are to be sharpened. My machine may be modified to provide sharpening capabilities for two lip taper shank twist drills.

While a preferred embodiment of my invention has been shown and described, it is to be understood that variations and changes may be resorted to without departing from the spirit of my invention as defined by the appended claims.

What I claim is:

1. An improved twist drill sharpening machine for sharpening two lip straight shank twist drills, said machine being capable of sharpening different diameter drill bits over the commonly used range of drill sizes and drill lengths, said machine having a base and an in-feed table reciprocable on said base along an in-feed axis A, a chuck fast on said in-feed table and constructed to hold therein a drill bit to be sharpened, said drill bit having two clearance faces and two cutting edges thereon, a grinding wheel spindle and a grinding wheel reciprocable on said base along a grinding axis B perpendicular to said in-feed axis A, said grinding wheel having a concave grinding surface profile on its periphery in the form of a generated curve such that different portions of said profile correspond to the different drill sizes to be sharpened, said grinding wheel profile having grit and a matrix plated thereon so that it does not need wheel dressing during use thereof, means for holding said chuck on said in-feed table so that said drill bit is held at a workpiece axis C disposed between said axes A and B, the angle that workpiece axis C makes with grinding axis B being equal to one-half of the included angle of the sharpened point to be placed on said drill bit, means using the present point of said drill bit for loading it in said chuck and orienting it radially in respect thereto so that said edges are maintained substantially parallel to axis B, means for incrementally moving said in-feed table along axis A so that said drill bit reaches axis B, means for flip-flopping said chuck and said drill bit held therin at each increment of in-feed of said drill bit, said means for flip-flopping said chuck and said drill bit held therein rotating said chuck through alternate reversing arcs of 180 degrees, incremental in-feed of the drill bit occuring during every other 180 degree rotation of said chuck, an hydraulic cushioning device for absorbing the inertia of said chuck as it travels through said alternate reversing arcs, said cushioning device constructed to bring said drill bit to rest at a predetermined point in respect to grinding axis B, said chuck having an elongated hollow cylindrical body having an unobstructed axial cavity therein for receiving workparts to be clamped of indefinite length, a plurality of circumferentially spaced apart clamping jaws and a clamping ring moveably carried on said body, said clamping ring and said clamping jaws being interlocked with each other so that they move together in unison and fluid powered means for actuating said clamping ring to move said clamping jaws into clamping position about said drill bit to be clamped, said fluid powered means disposed outside of said body, said clamping ring disposed outside of said body, said clamping jaws operative through the outside wall of said body and moveable radially thereof so that they close substantially at the axis of said body, means for sensing the clamping and unclamping movement of said chuck and means responsive to said sensing for raising and lowering said grinding wheel in respect to said base substantially along axis D, means for cycling said grinding wheel back and forth along axis B in respect to said drill bit for carrying out a grinding operation thereon, said means for cyclically reciprocating said grinding wheel constructed and arranged so that during the sharpening process said grinding wheel makes at least two grinding passes across each clearance face of said drill bit, and means for retracting said grinding wheel to a static position remote from its cyclic path of travel to allow loading and unloading of said bit.

2. An improved twist drill sharpening machine for sharpening two lip twist drills, said machine being capable of sharpening different diameter drill bits over the commonly used range of drill sizes and drill lengths, said machine having a base and a chuck reciprocable on said base along an in-feed axis A, said chuck constructed to hold therein a drill bit to be sharpened, said drill bit having two clearance faces and two cutting edges thereon to be sharpened, a grinding wheel spindle and a grinding wheel, means for reciprocating said grinding wheel spindle on said base along a grinding axis B perpendicular to said in-feed axis A, said grinding wheel having a concave grinding surface profile on its periphery in the form of a generated curve such that different portions of said profile correspond to the different drill sizes to be sharpened, means for holding said chuck on said base so that said drill bit is held at a workpiece axis C disposed between axes A and B, the angle that workpiece axis C makes with grinding axis B being equal to one-half of the included angle of the sharpened point to be placed on said drill bit, means for loading said drill bit in said chuck and orienting it radially in respect thereto, and means for moving said chuck and said grinding wheel relative to each other along axes A and B, respectively, so that said grinding wheel carries out metal removal grinding operations on said drill bit for sharpening same, said means for reciprocating said grinding wheel spindle and said means for in-feed of said chuck so constructed in relation to each other that for each said clearance face said grinding operations are effected in a minimum of two grinding passes of the grinding wheel relative to said drill bit, said clearance face to be sharpened being disposed on said peripheral grinding surface so that the same is ground by the curvature of said peripheral grinding surface and so that said grinding wheel can move along axis B clear of said drill bit during each said grinding pass and further comprising means for flip-flopping said chuck and drill bit held therein at each increment of in-feed thereof.

3. An improved twist drill sharpening machine for sharpening two lip twist drills having a base, a chuck for chucking a drill bit to be sharpened, and a grinding wheel spindle supported on said base, a grinding wheel fast on said spindle, said grinding wheel having a concave grinding surface profile on its periphery, means for moving said chuck and grinding wheel relative to each other so that said grinding wheel carries out metal removal grinding operations on said drill bit for sharpening same, and said drill bit being in-fed to said grinding wheel on an axis parallel to the grinding wheel axis while held disposed at an acute angle to said infeed axis and further comprising means for flip-flopping said chuck and drill bit held therein at each increment or in-feed thereof.

4. An improved drill sharpening machine for sharpening drills having a base, a chuck for chucking a drill bit to be sharpened, and a grinding wheel spindle supported on said base, a grinding wheel fast on said spindle, said grinding wheel having a grinding surface on its periphery, means for moving said chuck and said grinding wheel relative to each other so that said grinding wheel carries out metal removal grinding operations on said drill bit for sharpening same, and said drill bit being in-fed to said grinding wheel on an axis parallel to the grinding wheel axis while held disposed at an acute angle to said in-feed axis and further comprising means for flip-flopping said chuck and said drill bit held therein at each increment of in-feed thereof, and means for cushioning the flip-flopping of said chuck at each extreme of its flip-flop travel, and means for automatically controlling said in-feed and flip-flopping of the drill bit W and for returning it to its in-feed starting position upon completion of the grinding operation thereon.

5. An improved twist drill sharpening machine as claimed in claim 2, said chuck having an elongated hollow cylindrical body having an unobstructed axial cavity therein for receiving workparts to be clamped of indefinite length, a plurality of circumferentially spaced apart clamping jaws and a clamping ring moveably carried on said body, said clamping ring and said clamping jaws being interlocked with each other so that they move together in unison and fluid powered means for actuating said clamping ring to move said clamping jaws into clamping position about a drill bit to be clamped.

6. An improved twist drill sharpening machine as claimed in claim 2 further comprising said means for cyclically reciprocating said grinding wheel along axis B constructed and arranged so that during the sharpening process it makes at least two passes across each face of said drill bit.

7. An improved twist drill sharpening machine as claimed in claim 2, said grinding wheel profile having grit and a matrix plated thereon so that it does not need wheel dressing during use thereof.

8. An improved twist drill sharpening machine as claimed in claim 2, both said fluid powered means and said clamping ring disposed outside said body, said clamping jaws operative through the outside wall of said body and moveable radially of said body so that they close substantially at the axis therof.

9. An improved twist drill sharpening machine as claimed in claim 2 or in claim 1, further comprising means for varying the stationary position of said chuck on said in-feed table so as to vary the angle that said workpiece axis C makes with axis B, whereby to accommodate different included angles for drill points to be sharpened.

10. An improved twist drill sharpening machine as claimed in claim 2 or in claim 1, said means for loading said drill bit in said chuck comprising a locating pad and spring fingers simultaneously operative upon said drill bit, said locating pad abutting against the point of said drill bit and said spring fingers holding said edges for respectively orientating said drill bit axially and radially in respect to said chuck.

11. An improved twist drill sharpening machine as claimed in claim 2 or claim 1, further comprising a hinged assembly for supporting said grinding wheel on said base, said hinged assembly having a moveable free end, cam means operative upon said free end, and fluid cylinder and piston means for controlling said cam means, a piston of said cylinder and piston means being operative upon said chuck for sensing the opening and closing movements thereof.

12. An improved twist drill sharpening machine as claimed in claim 2, said means for flip-flopping said chuck and the drill bit held therein rotating said chuck through alternate reversing arcs of 180 degrees, incremental in-feed of the drill bit occurring during every other 180 degree rotation thereof.

13. An improved twist drill sharpening machine as claimed in claim 12, further comprising an hydraulic cushioning device for absorbing the inertia of said chuck as it travels through said alternate reversing arcs, said cushioning device constructed to bring said drill bit to rest at a predetermined point in respect to grinding axis B.

14. An improved twist drill sharpening machine as claimed in claim 1 or in claim 13, said cushioning device having a housing, a piston moveable in said housing, and an impingement member projecting from said housing so as to be struck by said chuck for driving said piston during the shock absorbing stroke of said cushioning device, and a pillar in said housing on which said piston is moveable, said pillar having orifice means thereon for passage of oil escaping from the path of movement of said piston, the cross-section of said orifice means diminishing in size in proportion to the amount of movement of said piston along said pillar.

15. An improved twist drill sharpening machine as claimed in claim 14, said impingement member and said piston bottoming out with each other in said housing at the end of the shock absorbing stroke to predetermine the point in respect to said grinding axis B at which said chuck is brought to rest.

16. An improved twist drill sharpening machine as claimed in claim 14, said impingement member being hollow and serving as a transfer chamber for oil escaping from the path of movement of said piston during the shock absorbing stroke of said cushioning device.

17. An improved twist drill sharpening machine as claimed in claim 2 or in claim 5, further comprising means for sensing the clamping and unclamping movement of said chuck and means responsive to said sensing for raising and lowering said grinding wheel in respect to said base substantially along axis D.

18. An improved twist drill sharpening machine as claimed in claim 11, said cylinder and piston means including a pair of fluid operated cylinders, a piston of one of said cylinders being made fast to said cam means, and a piston of the other of said cylinders being made to bear against and move with a part of said chuck.

19. An improved twist drill sharpening machine as claimed in claim 6, further comprising means for retracting said grinding wheel to a static position remote from its cyclic path of travel to allow loading or unloading of a drill bit in respect to said clamping device.

20. An improved twist drill sharpening machine as claimed in claim 8, said clamping jaws moveable both forwardly and radially of said body, the amount of such movement being inversely proportional to the diameter of the workpiece to be clamped, whereby the smaller the diameter of the workpiece the closer to the front end thereof it is clamped.

21. An improved method for sharpening two lip twist drills, said method being capable of sharpening different diameter drill bits over the commonly used range of drill sizes and drill lengths, said method comprising providing a base and chuck for chucking a drill to be sharpened, reciprocating said chuck on said base along an in-feed axis A, said drill bit having two clearance faces and two cutting edges thereon to be sharpened, providing a grinding wheel and reciprocating it along a grinding axis B perpendicular to said in-feed axis A, providing a concave grinding surface profile on the periphery of said grinding wheel in the form of a generated curve such that different portions of said profile correspond to the different drill sizes to be sharpened, holding said chuck on said base so that said drill bit is held at a workpiece axis C disposed between said axes A and B; the angle that workpiece axis C makes with grinding axis B being equal to one-half of the included angle of the sharpened point to be placed on said drill bit, loading said drill bit in said chuck and orienting it radially in respect thereto and moving said chuck and said grinding wheel relative to each other along axes A and B, respectively, so that said grinding wheel carries out metal removal grinding operations on said drill bit for sharpening same, reciprocating said grinding wheel and infeeding said chuck so that for each clearance face said grinding operations are effected in a minimum of two grinding passes of the grinding wheel relative to said drill bit, said clearance face to be sharpened being disposed on said peripheral grinding surface so that the same is ground on said drill bit by the curvature of said peripheral grinding surface and so that said grinding wheel can move along axis B clear of said drill bit during each said grinding pass and further comprising providing flip-flopping said chuck and drill bit held therein at each increment of in-feed thereof.

22. An improved method of sharpening two lip straight shank twist drills, said method being capable of sharpening different diameter drill bits over the commonly used range of drill sizes and drill lengths, said method comprising providing a base and an in-feed table reciprocable on said base along an in-feed axis A, providing a chuck fast on said in-feed table and holding therein a drill bit to be sharpened, said drill bit having opposite clearance faces and cutting edges thereon, providing a grinding wheel and reciprocating it on said base along a grinding axis B perpendicular to said in-feed axis A, providing a concave grinding surface profile on the periphery of said grinding wheel in the form of a generated curve such that different portions of said profile correspond to the different drill sizes to be sharpened, said grinding wheel profile having grit and a matrix plated thereon so that it does not need wheel dressing during use thereof, holding said chuck on said in-feed table so that said drill bit is held at a workpiece axis C disposed between and intersecting said axes A and B, the angle that workpiece axis C makes with grinding axis B being equal to one-half of the included angle of the sharpened point to be placed on said drill bit, using the present point of said drill bit for loading the same in said chuck and orientating it radially in respect thereto so that edges are maintained substantially parallel to axis B, incrementally moving said in-feed table along axis A so that said drill bit reaches axis B, flip-flopping said chuck and said drill bit held therein at each increment of in-feed of said drill bit, said flip-flopping of said chuck and said drill bit held therein rotating said chuck through alternate reversing arcs of 180 degrees, incremental in-feed of said drill bit occurring during every other 180 degree rotation of said chuck, providing an hydraulic cushioning device for absorbing the inertia of said chuck as it travels through said alternate reversing arcs, constructing said cushioning device to bring said drill bit to rest at a predetermined point in respect to grinding axis B, providing an elongated hollow cylindrical body for said chuck having an unobstructed axial cavity therein for receiving workparts to be clamped of indefinite length, providing a plurality of circumferentially spaced apart clamping jaws and a clamping ring moveably carried on said body, interlocking said clamping ring and said clamping jaws with each other so that they move together in unison and fluid powderedly actuating said clamping ring to move said clamping jaws into clamping position about said drill bit to be clamped, disposing said clamping ring outside of said body, said clamping jaws operative through the outside wall of said body and moveable radially thereof so that they close substantially at the axis of said body, sensing the clamping and unclamping movement of said chuck and responding to said sensing for raising and lowering said grinding wheel in respect to said base substantially along axis D, cycling said grinding wheel back and forth along axis B in respect to said drill bit for carrying out a grinding operation thereon, arranging the cylical reciprocation of said grinding wheel so that during the sharpening process said grinding wheel makes at least two passes across each face of said drill bit, and retracting said grinding wheel to a static position remote from its cyclic path of travel to allow loading or unloading of said drill bit.

23. An improved method for sharpening two lip twist drills comprising providing a base and supporting thereon a chuck for chucking a drill bit to be sharpened and a grinding wheel spindle, a grinding wheel fast on said spindle, providing a concave grinding surface profile on the periphery of said grinding wheel, moving said chuck and grinding wheel relative to each other so that said grinding wheel carries out metal removal grinding operations on said drill bit for sharpening same, and in-feeding said drill bit to said grinding wheel on an axis parallel to the grinding wheel axis while holding same disposed at an acute angle to said in-feed axis and further comprising providing flip-flopping said chuck and drill bit held therein at each increment of in-feed thereof.

24. An improved method for sharpening drills comprising providing a base and supporting thereon a chuck for chucking a drill bit to be sharpened and a grinding wheel spindle, a grinding wheel fast on said spindle, providing a grinding surface on the periphery of said grinding wheel, moving said chuck and grinding wheel relative to each other so that said grinding wheel carries out metal removal grinding operations on said drill bit for sharpening same and in-feeding said drill bit to said grinding wheel on an axis parallel to the grinding wheel axis while holding same disposed at an acute angle to said in-feed axis and further comprising providing flip-flopping said chuck and said drill bit held therein at each increment of in-feed thereof and cushioning the flip-flopping of said chuck at each extreme of its flip-flop travel and automatically controlling of said in-feed, and flip-flopping of the drill bit and for returning it to its in-feed starting position upon completion of the grinding operation thereon.

25. An improved method for sharpening two lip straight shank twist drills as claimed in claim 21 providing an elongated hollow body for said chuck, said body having an unobstructed axial cavity therein for receiving workparts to be clamped of indefinite length, movably carrying on said body a plurality of circumferentially spaced apart clamping jaws and a clamping ring, interlocking said clamping ring and said clamping jaws with each other so that they move together in unison, and actuating said clamping ring to move said clamping jaws into clamping position about a drill bit to be clamped.

26. An improved method for sharpening two lip twist drills as claimed in claim 21, further comprising cyclically reciprocating said grinding wheel along axis B so that during the sharpening process it makes at least two passes across each face of said drill bit.

27. An improved method for sharpening two lip twist drills as claimed in claim 21, in which said grinding wheel profile has grit and a matrix plated thereon so that it does not need wheel dressing during use thereof.

28. An improved method for sharpening two lip straight shank twist drills as claimed in claim 22, said actuation of said clamping jaws occurring outside of said body, said clamping jaws operative through the outside wall of said body and moveable radially thereof so that they close substantially at the axis of said body.

29. An improved method for sharpening two lip twist drills as claimed in claim 21 or in claim 22, further comprising varying the stationary position of said chuck on said in-feed table so as to vary the angle that said workpiece axis C makes with axis B, whereby to accommodate different included angles for drill points to be sharpened.

30. An improved method for sharpening two lip twist drills as claimed in claim 21 or in claim 22, further comprising using a locating pad and spring fingers simultaneously operative upon said drill bit for loading said drill bit in said chuck, said locating pad abutting against the point of said drill bit and said spring fingers holding said edges for respectively orientating said drill bit axially and radially in respect to said chuck.

31. An improved method for sharpening two lip twist drills as claimed in claim 21 or in claim 22, further comprising providing a hinged assembly for supporting said grinding wheel on said base, said hinged assembly having a moveable free end, camming said free end, and controlling said camming by sensing the opening and closing movements of said chuck.

32. An improved method for sharpening two lip twist drills as claimed in claim 21, said flip-flopping of the chuck and drill bit held therein rotating said chuck through alternate reversing arcs of 180 degrees, incrementally infeeding the drill bit during every other 180 degree rotation thereof.

33. An improved method for sharpening two lip twist drills as claimed in claim 32, further comprising using an hydraulic cushioning device for absorbing the inertia of said chuck as it travels through said alternate reversing arcs, arranging said cushioning device to bring said drill bit to rest at a predetermined point in respect to axis B.

34. An improved method for sharpening two lip twist drills as claimed in claim 22 or in claim 33, said cushioning device having a housing and an impingement member projecting therefrom so as to be struck by said chuck, said cushioning device having a piston driven by said impingement member, providing orifice means for passage of oil escaping from the path of movement of said piston, the cross-section of said orifice means diminishing in size in proportion to the amount of movement of said piston in the power stroke of said cushioning device.

35. An improved method for sharpening two lip twist drills as claimed in claim 34, said impingement member and said piston bottoming out with each other at the end of the shock absorbing stroke to predetermine the point in respect to said grinding axis B at which said chuck is brought to rest.

36. An improved method for sharpening two lip twist drills as claimed in claim 34, making said impingement member hollow so as to serve as a transfer chamber for oil escaping from the path of movement of said piston during the shock absorbing stroke of said cushioning device.

37. An improved method for sharpening two lip straight shank twist drills as claimed in claim 22 or in claim 25, further comprising sensing the clamping and unclamping movement of said chuck and, in response to said sensing raising and lowering said grinding wheel in respect to said base substantially along axis D.

38. An improved method for sharpening two lip twist drills as claimed in claim 31, further comprising using cylinder and piston means to accomplish said sensing and for controlling said camming.

39. An improved method for sharpening two lip straight shank twist drills as claimed in claim 26, further comprising retracting said grinding wheel to a static position remote from its cyclic path of travel to allow loading or unloading of said drill bit.

40. An improved method for sharpening two lip straight shank twist drills as claimed in claim 28, said clamping jaws being moveable both forwardly and radially of said body, the amount of such movement being inversely proportional to the diameter of the workpiece to be clamped, whereby the smaller the diameter of the workpiece the closer to the front end thereof it is clamped.

* * * * *

UNITED STATES PATENT OFFICE

CERTIFICATE OF CORRECTION

Patent No. 4,455,786 Dated June 26, 1984

Inventor(s) Lynn A. Maysilles

It is certified that error appears in the above-identified patent and that said Letters Patent are hereby corrected as shown below:

Column 1, Line 49 "chunk" should be "chuck".
Column 6, Line 57, "grooves" should be "grooved".
Column 10, Line 2 "reserves" should be "reverses".
Column 15, Line 31 "infeed" should be "in-feed".
Column 15, Line 33 "or" should be "of".
Column 17, Line 36 insert "bit" between "drill" and "to".
Column 17, Line 57 "infeeding" should be "in-feeding".
Column 18, Line 47 "powderedly" should be "poweredly".
Column 20, Line 15 "infeeding" should be "in-feeding".

Signed and Sealed this

*Fifth* Day of *March 1985*

[SEAL]

*Attest:*

DONALD J. QUIGG

*Attesting Officer* *Acting Commissioner of Patents and Trademarks*